US008288332B2

(12) United States Patent
Fossum et al.

(10) Patent No.: US 8,288,332 B2
(45) **Date of Patent: *Oct. 16, 2012**

(54) FABRIC CARE CONDITIONING COMPOSITION IN THE FORM OF AN ARTICLE

(75) Inventors: Renae Dianna Fossum, Middletown, OH (US); Robert Wayne Glenn, Jr., Liberty Township, OH (US); Heather Anne Doria, Hamilton, OH (US); Mark Robert Sivik, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 231 days.

This patent is subject to a terminal disclaimer.

(21) Appl. No.: 12/831,618

(22) Filed: Jul. 7, 2010

(65) Prior Publication Data

US 2011/0023240 A1 Feb. 3, 2011

Related U.S. Application Data

(60) Provisional application No. 61/229,981, filed on Jul. 30, 2009.

(51) Int. Cl.
*C11D 17/00* (2006.01)

(52) U.S. Cl. ..... 510/440; 510/521

(58) Field of Classification Search ..... 510/440, 510/521

See application file for complete search history.

(56) References Cited

U.S. PATENT DOCUMENTS

| | | | | |
|---|---|---|---|---|
| 3,299,112 | A | 1/1967 | Bailey | |
| 3,594,328 | A | 7/1971 | Schibler | |
| 3,929,678 | A | 12/1975 | Laughlin et al. | |
| 4,234,627 | A | 11/1980 | Schilling | |
| 4,424,134 | A | 1/1984 | Sissin et al. | |
| 4,514,461 | A | 4/1985 | Woo | |
| 4,539,135 | A | 9/1985 | Ramachandran | |
| RE32,713 | E | 7/1988 | Woo | |
| 4,767,547 | A | 8/1988 | Straathof et al. | |
| 4,818,421 | A | 4/1989 | Boris et al. | |
| 4,882,220 | A | 11/1989 | Ono et al. | |
| 4,911,852 | A | 3/1990 | Coffindaffer et al. | |
| 4,917,920 | A | 4/1990 | Ono et al. | |
| 5,082,578 | A | 1/1992 | Langer et al. | |
| 5,457,895 | A | 10/1995 | Thompson | |
| 5,463,416 | A | 10/1995 | Paton | |
| 5,545,340 | A | 8/1996 | Wahl | |
| 5,545,350 | A | 8/1996 | Baker | |
| 5,562,849 | A | 10/1996 | Wahl | |
| 5,574,179 | A | 11/1996 | Wahl | |
| 5,651,976 | A | 7/1997 | Price | |
| 5,807,956 | A | 9/1998 | Czech | |
| 5,858,959 | A | 1/1999 | Surutzidis | |
| 5,981,459 | A * | 11/1999 | Verbiest et al. | 510/279 |
| 5,981,681 | A | 11/1999 | Czech | |
| 6,048,830 | A | 4/2000 | Gallon | |
| 6,106,849 | A | 8/2000 | Malkan | |
| 6,200,949 | B1 | 3/2001 | Reijmer | |
| 6,245,732 | B1 | 6/2001 | Gallon | |
| 6,458,754 | B1 | 10/2002 | Velazquez | |
| 6,551,986 | B1 | 4/2003 | Littig | |
| 6,642,200 | B1 | 11/2003 | Zhang | |
| 6,645,479 | B1 | 11/2003 | Shefer | |
| 6,740,631 | B2 | 5/2004 | Shefer | |
| 6,787,512 | B1 | 9/2004 | Verrall | |
| 6,815,069 | B2 | 11/2004 | Hohberg | |
| 6,903,061 | B2 | 6/2005 | Masschelein | |
| 7,053,034 | B2 | 5/2006 | Shefer | |
| 7,125,835 | B2 | 10/2006 | Bennett | |
| 7,135,451 | B2 | 11/2006 | Corona, III | |
| 7,153,924 | B2 | 12/2006 | Kuepfer | |
| 7,196,049 | B2 | 3/2007 | Brain | |
| 7,238,655 | B2 | 7/2007 | Ness | |
| 7,273,837 | B2 | 9/2007 | Boutique | |
| 7,321,019 | B2 | 1/2008 | Ziche | |
| 7,335,630 | B2 | 2/2008 | Delplancke | |
| 7,365,043 | B2 | 4/2008 | Baker | |
| 7,381,697 | B2 | 6/2008 | Lentsch | |
| 7,427,648 | B2 | 9/2008 | Ochs | |
| 7,585,824 | B2 | 9/2009 | Popplewell | |
| 7,723,284 | B2 | 5/2010 | Mane | |
| 7,799,752 | B2 | 9/2010 | Ness | |
| 2003/0017959 | A1 * | 1/2003 | Baeck et al. | 510/445 |
| 2003/0125222 | A1 | 7/2003 | Jahns | |
| 2003/0158344 | A1 | 8/2003 | Rodriques | |
| 2003/0165692 | A1 | 9/2003 | Koch | |
| 2003/0215417 | A1 | 11/2003 | Uchiyama | |
| 2003/0216488 | A1 | 11/2003 | Uchiyama | |
| 2004/0053808 | A1 * | 3/2004 | Raehse et al. | 510/447 |
| 2004/0071742 | A1 | 4/2004 | Popplewell | |
| 2005/0098759 | A1 | 5/2005 | Frankenbach | |
| 2005/0170994 | A1 | 8/2005 | Casado-Dominguez | |
| 2005/0192207 | A1 | 9/2005 | Morgan, III | |
| 2006/0252668 | A1 | 11/2006 | Frankenbach | |
| 2007/0225388 | A1 | 9/2007 | Cooper | |
| 2007/0275866 | A1 | 11/2007 | Dykstra | |
| 2009/0263342 | A1 | 10/2009 | Glenn, Jr. | |

FOREIGN PATENT DOCUMENTS

| | | |
|---|---|---|
| EP | 0283165 B1 | 10/1992 |
| EP | 1141207 | 11/1999 |
| WO | WO 00/20157 | 4/2000 |
| WO | WO 00/56849 | 9/2000 |
| WO | WO 03/091028 A1 | 11/2003 |
| WO | WO 2005/002360 | 1/2005 |
| WO | WO 2009095891 | 8/2009 |
| WO | WO 2010043692 A1 | 4/2010 |

OTHER PUBLICATIONS

U.S. Appl. No. 12/847,093, Jul. 30, 2010, Fossum, et al.

(Continued)

*Primary Examiner* — John Hardee

(74) *Attorney, Agent, or Firm* — James F. McBride; Steven W. Miller

(57) ABSTRACT

Fabric conditioning compositions such as those that are typically provided to the consumer in liquid form are disclosed. The fabric care conditioning composition is in the form of a porous, dissolvable substrate. The substrate comprises diester quaternary ammonium compound, water soluble polymer and Remaining Water. The substrate may take any number of suitable shapes.

4 Claims, No Drawings

OTHER PUBLICATIONS

U.S. Appl. No. 12/847,110, Jul. 30, 2010, Fossum, et al.
U.S. Appl. No. 61/024,728, filed Jan. 30, 2008, Glenn, Jr., Robert Wayne.
U.S. Appl. No. 61/045,444, filed Apr. 16, 2008, Glenn, Jr., Robert Wayne.
U.S. Appl. No. 12/361,634, filed Sep. 17, 2008, Glenn, Jr., Robert W.
U.S. Appl. No. 12/080,358, filed Oct. 2, 2008, Wahl, Errol Hoffman.
U.S. Appl. No. 61/120,637, filed Dec. 8, 2008, Glenn, Jr., Robert Wayne.
U.S. Appl. No. 61/120,643, filed Dec. 8, 2008, Glenn, Jr., Robert Wayne.
U.S. Appl. No. 61/120,765, filed Dec. 8, 2008, Glenn, Jr., Robert Wayne.
U.S. Appl. No. 61/120,786, filed Dec. 8, 2008, Glenn, Jr., Robert Wayne.
U.S. Appl. No. 61/120,790, filed Dec. 8, 2008, Glenn, Jr., Robert Wayne.
U.S. Appl. No. 61/170,150, filed Apr. 17, 2009, Panandiker, Rajan Keshav.
U.S. Appl. No. 61/221,632, filed Jun. 30, 2009, Panandiker, Rajan Keshav.
U.S. Appl. No. 61/229,981, filed Jul. 30, 2009, Fossum, Renae Dianna.
U.S. Appl. No. 61,319,939, filed Apr. 1, 2010, Cox, Jeremy Wayne.

* cited by examiner

FABRIC CARE CONDITIONING COMPOSITION IN THE FORM OF AN ARTICLE

CROSS-REFERENCE TO RELATED APPLICATIONS

This application claims priority under 35 USC §119(e) to U.S. Provisional Application Ser. No. 61/229,981, filed Jul. 30, 2009.

FIELD OF THE INVENTION

The present invention relates to fabric care conditioning compositions, especially those that are in the form of an article that is a porous, dissolvable solid structure and methods of making the same.

BACKGROUND OF THE INVENTION

Through the wash fabric conditioning products are often sold in liquid form. The liquid may be provided in bulk such that one package will contain multiple doses. Consumers will open the package and meter doses into the washing machine and/or laundry liquor as needed.

Although widely used, bulk liquid product forms may have associated issues in terms of packaging, storage, transportation and/or convenience of use. For example, liquid fabric conditioning products are typically sold in bottles which may add significant cost to the finished product. Additionally, liquid fabric conditioning products may comprise a substantial amount of water in the formula. The high water content increases the bulk of the product which may in turn adversely impact the associated shipping and storage costs. Additionally, liquid laundry conditioning products can be messy. This messiness may cause inconvenience to the consumer when attempting to meter out an accurate dose as it may result in drips and residue on the outside of the bottle as well as in the dispenser of the washing machine.

Liquid fabric conditioning formulations may also be characterized by physical stability challenges including, but not limited to, phase separation, gelling and creaming, any of which may lead to a shorter shelf life. The chemical stability of diester quaternary ammonium fabric softening actives in liquid formulations may be particularly challenging due to ester hydrolysis which may be dependent upon conditions including, but not limited to, pH and temperature.

Compatibility of other actives in a liquid fabric conditioning formula can be challenging due to for example: differences in the optimum pH of the actives; poor solubility of the active leading to precipitation in the product; chemical instability of the active such as via hydrolysis or cross-linking; and/or polymer-polymer interactions which may lead to undesirable rheological aesthetics such as stringiness or gelling of the product.

The aforementioned issues may be addressed by providing a liquid fabric conditioning formulation in the alternative form of a porous dissolvable solid structure containing little or no water. For example, such an article could be packaged as a single unit or in multiple units and shipped at a lower cost as compared to the traditional liquid form equivalent. Such an article could eliminate the difficulty and mess associated with handling a liquid fabric conditioning formulation since no metered pouring would be required. Moreover, many of the stability issues of the liquid form would be eliminated via physical separation such that actives could be combined in new ways that were heretofore impractical and/or impossible.

However, for porous dissolvable solid structures to be a practical form in which to supply a liquid fabric conditioning composition to the consumer, several further challenges must be addressed. For example, it may be required that a relatively high activity of fabric softening active such as a diester quaternary ammonium compound be incorporated into the foams at a high enough density such that the amount of fabric softening active that is delivered is sufficient to soften the clothes. In this way, the use of a porous dissolvable solid structure provides several advantages over the like use of a film. For example, the relatively higher surface area of the porous dissolvable solid structure allows for much higher loading of fabric softening active since this type of substrate rapidly dissolves in the washing machine or hand rinse applications, particularly those in which the water volume may be small and the water temperature may be cold (for example, under rinse conditions in 3 minutes using 15° C. water).

Yet the amount of fabric softening active incorporated into a porous dissolvable solid structure, and/or the dry density of the substrate, may require impractical dimensions of the substrate in order to deliver an effective dose to the washing machine and/or the hand rinse apparatus. For example, the open cell dissolvable substrate described as having a dry density range of 0.06 g/cm$^3$ to about 0.10 g/cm$^3$ in U.S. patent application Ser. No. 12/361,634, may not be practical for a fabric care application because it would require a large size dissolvable porous substrate that may be difficult to handle, or might not fit into the dispensing drawer of a front-loading washing machine. For example, a dissolvable porous substrate with a density of 0.10 g/cm$^3$ and a thickness of 0.8 cm with a diester quaternary ammonium compound activity of 40% would require a 12.5 cm×12.5 cm size foam to deliver a dose of quat of 5 g as calculated according to the equations below:

$$\text{(g Quat/dose)/(\% Quat activity in porous substrate)=g dissolvable porous substrate} \quad \text{(eq 1)}$$

$$\text{(g dissolvable porous substrate)/(dry density (g/cm}^3\text{))= volume dissolvable porous substrate} \quad \text{(eq 2)}$$

$$\text{volume dissolvable porous substrate/thickness=area dissolvable porous substrate} \quad \text{(eq 3)}$$

Likewise, a dissolvable porous substrate with a density of 0.06 g/cm$^3$ and a thickness of 0.8 cm with a Quat activity of 40% would require a 16 cm×16 cm size foam to deliver 5 g of Quat active to the wash.

Dissolvable films are known comprising water-soluble polymeric structurant and a surfactant or other active component. However, in order to achieve the requisite rapid dissolution rates needed for consumer convenience, these films are generally on the order of less than 100 microns thickness (typically 50 microns) and, thereby, are generally of too low a basis weight (typically 50-100 grams of solid per square meter) to enable feasible consumer application of a sufficient dosage.

Freeze-dried open-celled porous solids for personal care have been taught (See U.S. Pat. No. 6,106,849 and US 2007/0225388). However, such resulting freeze-dried porous solids are rigid, brittle and fragile and without plasticization of the polymer such that it remains in its glassy state to avoid collapse of the structure during the process (See U.S. Pat. No. 5,457,895 Kearney P. et. al., issued 1995). Also, freeze-drying is a relatively high energy and costly process.

Based upon the foregoing, a need exists for a flexible, bendable, and soft to the touch, dissolvable porous solid structure which can be easily and quickly formulated and manufactured and that provides the properties of flexibility, dissolution and fabric conditioning desired by consumers. Such a structure should be provided to the consumer in a size that is easy to dose such as in the drawer of a front-loading washing machine, or easy to dose in a sachet for a hand-rinsing application.

SUMMARY OF THE INVENTION

It is therefore an object of the present invention to provide a fabric conditioning composition in the form of a porous, dissolvable solid structure that can be conveniently and quickly dosed and dissolved in the wash or rinse liquor, while providing excellent conditioning benefits. It is a further object of the present invention to provide such a product that can be produced in an economical manner by physical aeration followed by subsequent drying. It is an even further object of the present invention to provide such a product with desirable softness and flexibility.

In some embodiments, the fabric care conditioning article comprises by dry weight percentage from about 5% to about 60% of diester quaternary ammonium compound having the formula I, $$\{R_{4-m}—N^+—[Z—Y—R^1]_m\}X^- \quad (I)$$

wherein each R comprises hydrogen, a short chain $C_1$-$C_6$, a $C_1$-$C_3$ alkyl or hydroxyalkyl group, poly($C_{2-3}$ alkoxy), polyethoxy, benzyl, or mixtures thereof; each Z is independently selected from $(CH_2)$n, CH2-CH(CH3)- or CH—(CH3)-CH2-; each Y may is selected from —O—(O)C—, —C(O)—O—, —NR—C(O)—, or —C(O)—NR—; each m is 2 or 3; each n is from 1 to about 4; the sum of carbons in each $R^1$, plus one when Y is —O—(O)C— or —NR—C(O)—, is $C_{12}$-$C_{22}$, or $C_{14}$-$C_{20}$, each $R^1$ is selected from a hydrocarbyl, or substituted hydrocarbyl group; and $X^-$ selected from a softener-compatible anion comprising chloride, bromide, methylsulfate, ethylsulfate, sulfate, or nitrate. The fabric care conditioning article further comprises: from about 5% to about 60% water soluble polymer; from about 5% to about 30% plasticizer; from about 0% to about 25% nonionic surfactant; and from about 15 to about 50% Remaining Water. The article is in the form of a first flexible porous dissolvable solid structure and is characterized by a Percent Open Cell Content, dry density and diester quaternary ammonium compound activity.

In some embodiments, the fabric care conditioning article comprises by dry weight percentage from about 20% to about 40% of diester quaternary ammonium compound having the formula I;

$$\{R_{4-m}—N^+—[Z—Y—R^1]_m\}X^- \quad (I)$$

wherein each R comprises either hydrogen, a short chain $C_1$-$C_6$, in one aspect a $C_1$-$C_3$ alkyl or hydroxyalkyl group, poly($C_{2-3}$ alkoxy), polyethoxy, benzyl, or mixtures thereof; each Z is independently $(CH_2)$n, CH2-CH(CH3)- or CH—(CH3)-CH2-; each Y may comprise —O—(O)C—, —C(O)—O—, —NR—C(O)—, or —C(O)—NR—; each m is 2 or 3; each n is from 1 to about 4; the sum of carbons in each $R^1$, plus one when Y is —O—(O)C— or —NR—C(O)—, may be $C_{12}$-$C_{22}$, or $C_{14}$-$C_{20}$, with each $R^1$ being a hydrocarbyl, or substituted hydrocarbyl group; and $X^-$ may comprise any softener-compatible anion such as chloride, bromide, methylsulfate, ethylsulfate, sulfate, and nitrate. The fabric care conditioning article further comprises: from about 9% to about 20% polyvinyl alcohol; from about 10% to about 20% glycerol; from about 0% to about 25% sorbitan monostearate; from about 8% to 45% Remaining Water; from about 1% to about 4% neat perfume; from about 0.1% to about 3% perfume microcapsules; and from about 0.1% to 5% water soluble cationic polymer. The article is in the form of a porous dissolvable solid structure, wherein said article is characterized by Percent Open Cell Content, dry density and diester quaternary ammonium compound activity.

Fabric care conditioning articles comprising a porous dissolvable solid structure per the present invention may be made using a process comprising the following steps. A solution comprising water, film-forming water-soluble polymer water soluble polymer, plasticizer, diester quaternary ammonium compound and optionally nonionic surfactant is prepared. The solution comprises from about 20% to about 50% solids by weight of said pre-mix and has a viscosity of from about 2,500 centipoise to about 150,000 centipoise. The solution is aerated by introducing gas into the solution to form a wet aerated product. The wet aerated product is formed into a desired shape to form a shaped wet product. The shaped wet product is dried to a desired Remaining Water content to form a porous dissolvable solid structure.

DETAILED DESCRIPTION OF THE INVENTION

It has presently been found that dissolvable solid fabric conditioning products can be prepared that can be conveniently and quickly dissolved in the wash or rinse liquor to provide for delivery of fabric conditioning compositions previously provided to the consumer in liquid form. It has also been found that such products can be produced in an economical manner by physical aeration followed by subsequent drying. Additionally, it has been found that such products can now be produced with desirable softness and flexibility and in a convenient size.

Rapidly-dissolving porous solids with a predominantly open-celled structure can be produced via physical aeration followed by subsequent drying which is a more cost effective alternative to conventional freeze drying. This can be accomplished by creating a physically aerated wet foam with a controlled degree of foam instability during the drying process such that an optimum level of bubble breakage and coalescence occurs to generate a plurality of open channels. This can be accomplished without collapse of the foam plateau border in the three dimensional structure during the drying process thereby maintaining the physical strength and cohesiveness of the porous solid.

Instability and coalescence may be controllably manipulated such that the original closed-cell wet foam transforms within the drying process into a true open-celled porous structure wherein the plurality of open channels extend to the solid's surfaces. Such open-celled dissolvable porous solids prepared by physical aeration followed by drying can be prepared within specific rheological and compositional ranges (% solids). Moreover, such open-celled dissolvable porous solids can be prepared with significant plasticizer levels for desirable softness and flexibility.

The flexible porous dissolvable solid structure may be referred to herein as "the article" or "the dissolvable article". All references are intended to mean the flexible porous dissolvable solid structure.

As used herein, "flexible" means that the article meets the distance to maximum force values of from about 3 mm to about 30 mm, in one embodiment from about 7 mm to about 25 mm, in another embodiment from about 8 mm to about 20 mm, and in still another embodiment from about 9 mm to about 15 mm as measured by the Distance to Maximum Force Method.

As used herein, the flexible, porous substrate is also highly bendable and can recover its original shape. In one embodiment, a flat specimen can be bent in one embodiment from 0° to about 180°, and in another embodiment from 0° to about 135°, and in another embodiment from 0° to about 90°. Foam flexibility can be quantified by the ASTM D 3574-86, 3.3 test used to determine flexibility of a cellular organic polymeric foam product.

As used herein "porous solid structure" means a solid, interconnected, polymer-containing matrix that defines a network of spaces or cells that contain the gas of the surrounding atmosphere, typically air. The interconnectivity of the structure may be described by a Star Volume, a Structure Model Index (SMI) or a Percent Open Cell Content.

The article has a Star Volume of from about 1 $mm^3$ to about 90 $mm^3$, in one embodiment from about 5 $mm^3$ to about 80 $mm^3$, in another embodiment from about 10 $mm^3$ to about 70 $mm^3$, and in still another embodiment from about 15 $mm^3$ to about 60 $mm^3$. In some embodiments, the article has a non-negative Structure Model Index of from about 0.0 to about 3.0, in one embodiment from about 0.2 to about 2.5, and in another embodiment from about 0.3 to about 2.50. In other embodiments, the article has a negative Structure Model Index of from about 0.0 to about −3.0, in one embodiment from about −0.2 to about −2.5, and in another embodiment from about −0.3 to about −1.0. The article has a Percent Open Cell Content of from about 50% to 99.9%, in one embodiment from about 60% to about 97%, and in another embodiment from about 80% to about 95%.

To measure the cell interconnectivity via the Star Volume and the Structure Model Index, samples approximately 9 mm×12 mm and 5 to 10 mm high, are scanned using a micro computed tomography system (μCT40, SN 07030700, Scanco Medical AG) according to the method described in PCT Int. Appl. WO 2009095891 with the image acquisition parameters of 35 kVp, 180 μA, 300 ms integration time, 4 averaging, and 1000 projections. The reconstructed data set consists of a stack of images, each 2048×2048 pixels, with an isotropic resolution of 8 μm. For data analysis, a volume of interest is selected to be fully within the sample, avoiding the surface region. A typical volume of interest is 600×600×500 voxels.

Star Volume is a measure of the "openness" of the void space in a two phase structure and Structure Model Index (SMI) relates to the convexity of the structure. Ideal (flat) plates have an SMI of 0 (no surface change with dilation of the plates), whereas ideal cylindrical rods have an SMI of 3 (linear increase in surface with dilation of rods). Round spheres have an SMI of 4. Concave structures give negative SMI values. Artificial boundaries at the edge of the volume of interest are not included in the calculation and are thus suppressed. The SMI of the fexible porous substrates described herein is measured using Scanco Medical's Bone Trabecular Morphometry evaluation using a threshold of 35-45.

The Percent Open Cell Content is measured via gas pycnometry according to the method described in PCT Int Appl WO 2009095981 by Micromeretics Analytical Services, Inc. (One Micromeritics Dr, Suite 200, Norcross, Ga. 30093). More information on this technique is available on the Micromeretics Analytical Services web sites (www.particletesting.com or www.micromeritics.com), or published in a book, "Analytical Methods in Fine particle Technology", by Clyde Orr and Paul Webb.

The article has a maximum Cell Wall Thickness. The article has a Cell Wall Thickness of from about from about 0.02 mm to about 0.2 mm, in one embodiment from about 0.05 mm to about 0.18 mm, in another embodiment from about 0.03 mm to about 0.14 mm, and in still another embodiment from about 0.035 mm to about 0.07 mm.

The Cell Wall Thickness is computed from the scanned images via a micro computed tomography system (μCT40, SN 07030700, Scanco Medical AG) as described in PCT Int Appl WO 2009095981.

The article also has a minimum Specific Surface Area. The article has a Specific Surface Area of from about 0.03 $m^2/g$ to about 0.25 $m^2/g$, in one embodiment from about 0.035 $m^2/g$ to about 0.20 $m^2/g$, in another embodiment from about 0.04 $m^2/g$ to about 0.15 $m^2/g$, and in still another embodiment from about 0.04 $m^2/g$ to about 0.10 $m^2/g$.

The Specific Surface Area is measured via a gas adsorption technique described in PCT Int Appl WO 2009095981. It is recommended that the gas adsorption and pyncnometry measurements be conducted by Micromeretics Analytical Services, Inc. (One Micromeritics Dr, Suite 200, Norcross, Ga. 30093). More information on this technique is available on the Micromeretics Analytical Services web sites (www.particletesting.com or www.micromeritics.com), or published in a book, "Analytical Methods in Fine particle Technology", by Clyde Orr and Paul Webb.

In some embodiments, the article is a flat, flexible solid structure in the form of a pad, a strip or tape and having a thickness of from about 1.0 mm to about 50 mm, in one embodiment from about 2 mm to about 9 mm, in another embodiment from about 3 mm to about 8 mm, and in a further embodiment from about 4 mm to about 7 mm as measured by the below methodology. In another embodiment, the article is a three-dimensional solid structure in the form of a shape with a volume from about 0.3 $cm^3$ to about 500 $cm^3$, in another embodiment from about 1 $cm^3$ to about 300 $cm^3$, in another embodiment from about 10 $cm^3$ to about 200 $cm^3$, and in another embodiment from about 25 $cm^3$ to about 100 $cm^3$.

The thickness of the dissolvable porous solid (i.e., substrate or sample substrate) is obtained using a micrometer or thickness gage, such as the Mitutoyo Corporation Digital Disk Stand Micrometer Model Number IDS-1012E (Mitutoyo Corporation, 965 Corporate Blvd, Aurora, Ill., USA 60504). The micrometer has a 1 inch diameter platen weighing about 32 grams, which measures thickness at an application pressure of about 40.7 psi (6.32 $gm/cm^2$). In the case of cylindrical, spherical or other objects with more of a third dimension versus a pad or strip, the thickness is taken as the maximum distance of the shortest dimension, i.e., the diameter of a sphere or cylinder for instance, and the thickness ranges are the same as described above. The thickness of the dissolvable porous solid is measured by raising the platen, placing a section of the sample substrate on the stand beneath the platen, carefully lowering the platen to contact the sample substrate, releasing the platen, and measuring the thickness of the sample substrate in millimeters on the digital readout. The sample substrate should be fully extended to all edges of the platen to make sure thickness is measured at the lowest possible surface pressure, except for the case of more rigid substrates which are not flat. For more rigid substrates which are not completely flat, a flat edge of the substrate is measured using only one portion of the platen impinging on the flat portion of the substrate.

The article has a basis weight from about 800 $grams/m^2$ to about 6000 $grams/m^2$, in another embodiment from about 900 $grams/m^2$ to about 5000 $grams/m^2$, and in still another embodiment from about 1,000 $grams/m^2$ to about 4000 $grams/m^2$.

The Basis Weight of the dissolvable porous solid component of the fabric care conditioning article disclosed herein is calculated as the weight of the dissolvable porous solid component per area of the selected dissolvable porous solid ($grams/m^2$). The area is calculated as the projected area onto a flat surface perpendicular to the outer edges of the porous solid. For a flat object, the area is thus computed based on the area enclosed within the outer perimeter of the sample. For a spherical object, the area is thus computed based on the average diameter as $3.14\times(\text{diameter}/2)^2$. For a cylindrical object, the area is thus computed based on the average diameter and average length as diameter×length. For an irregularly shaped three dimensional object, the area is computed based on the side with the largest outer dimensions projected onto a flat surface oriented perpendicularly to this side. This can be accomplished by carefully tracing the outer dimensions of the object onto a piece of graph paper with a pencil and then computing the area by approximate counting of the squares and multiplying by the known area of the squares or by taking a picture of the traced area (preferably shaded-in for contrast) including a scale and using image analysis techniques.

The article has a dry density of from about 0.05 g/cm$^3$ to about 0.6 g/cm$^3$, in one embodiment from about 0.10 g/cm$^3$ to about 0.40 g/cm$^3$, and in an alternate embodiment from about 0.15 g/cm$^3$ to about 0.25 g/cm$^3$.

The dry density of the dissolvable porous solid is determined by the equation:

Calculated Dry Density=(Basis Weight of porous solid)/(Porous Solid Thickness) and has units of grams per cubic meter. The Basis Weight and Thickness of the dissolvable porous solid are determined in accordance with the methodologies described herein.

Rapidly dissolving porous solids with a predominantly inter-connected, open-celled structure can be produced via physical aeration followed by subsequent drying (as a more cost-effective alternative to conventional freeze drying). This can be accomplished by creating a physically aerated wet foam with a controlled degree of instability during the drying process such that an optimum level of bubble breakage and coalescence occurs to generate a plurality of open channels, and without collapse of the three dimensional foam plateau border structure during the drying process, thereby maintaining the physical strength and cohesiveness of the porous solid. This instability and coalescence can be controllably manipulated such that the original closed-cell wet foam transforms within the drying process into a true open-celled porous structure wherein the plurality of open channels extends to the solid's surface and with sufficient structural integrity.

Open-celled dissolvable porous solids prepared by physical aeration followed by drying can be achieved within a narrowly defined rheological range as defined above. Achieving the relatively low viscosity range required can be problematic due to the typically high polymeric structurant levels required for sufficient solid structure formation as well as at desired higher surfactant and % solids levels (for product compaction and sustainability). To achieve the required relatively low viscosity range of the present invention at relatively high diester quaternary ammonium compound, surfactant and polymer levels while producing integral and cohesive solid structures, several compositional strategies can be employed, either alone or in combination, including but not limited to: (i) employing water-soluble polymers within the requisite molecular weight range but with relatively low viscosity build as defined herein; (ii) deliberate dilution of the processing mixture with water in one or more steps; (iii) adding electrolyte or hydrotrope to manipulate the surfactant structure viscosity; or (iv) adding low molecular weight solvents to manipulate the viscosity. Importantly, aerating processing mixtures below the required viscosity range results in less desirable, low basis weight and non-cohesive porous solids.

It has also been found that the above described characteristics of the present invention apply toward the production of open-celled porous structures employing either semi-continuous or continuous aeration equipment from the food industry that are used for example in the manufacture of marshmallows.

The article may contain Remaining Water, which is defined as the amount of water in the article after drying under the specified conditions. The Remaining Water content will vary depending on the drying conditions and amount of water soluble polymer, plasticizer and quaternary ammonium compound added to the liquid composition.

The Remaining Water in the article after drying is calculated as the difference between the theoretical water loss and the actual water loss divided by the actual mass of the article after drying. This calculation is represented by the following equation:

% Remaining Water=[(Theoretical water loss)−(Actual water loss)]÷(Dried Foam Mass)

The theoretical water loss is calculated as the wet foam mass multiplied by the percent volatile content in the liquid composition. This calculation is represented by the following equation:

Theoretical water loss=(Wet Foam Mass)(% volatile content in wet composition)

The percent volatile content in the liquid composition is calculated as 1−the % solids of the liquid composition. This calculation is represented by the following equation:

% volatile in liquid composition=(1−% solids)

The actual water loss is calculated gravimetrically by weighing the wet foam in the plate before drying and the plate after drying in the examples described herein.

I. Composition

The articles of the present invention may comprise: fabric softening active; water-soluble polymer; plasticizer; surfactant; water; and optional compositions. These are discussed in further detail below. Note that any actives and/or compositions disclosed herein can be used in and/or with the articles, and in particular the personal care articles, disclosed in U.S. Patent Application Ser. Nos. 61/024,728; 12/361,634; 61/120,637; 61/120,765; 61/120,790; 61/120,786; 61/120,643; 12/424,812; and 61/045,444.

Fabric Softening Active

The articles of the present invention comprise one or more fabric softening actives. The term "fabric softening active" or "FSA" is used herein in the broadest sense to include any active that is suitable for softening a fabric.

In one embodiment of the invention, the FSA is a quaternary ammonium compound suitable for softening fabric in a rinse step. In one embodiment, the FSA is formed from a reaction product of a fatty acid and an aminoalcohol obtaining mixtures of mono-, di-, and, in one embodiment, triester compounds. In another embodiment, the FSA comprises one or more softener quaternary ammonium compounds such, but not limited to, as a monoalkylquaternary ammonium compound, dialkylquaternary ammonium compound, a diamido quaternary compound, a diester quaternary ammonium compound, a monoester quaternary ammonium compound or a combination thereof.

Exemplary quaternary ammonium compounds include, but are not limited to, alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof. Examples of fabric softener actives are described in U.S. Pat. No. 7,381,697, column 3, line 43-column 4, line 67; U.S. Pat. No. 7,135,451, column 5, line 1-column 11, line 40. See also U.S. Pat. Nos. 4,424,134; 4,767,547; 5,545,340; 5,545,350; 5,562,849; and 5,574,179.

Fabric Softening Active Compounds

The fabric softening active may comprise, as the principal active, compounds of the following formula:

$$\{R_{4-m}—N^+—[Z—Y—R^1]_m\}X^- \quad (1)$$

wherein each R comprises either hydrogen, a short chain $C_1$-$C_6$, in one aspect a $C_1$-$C_3$ alkyl or hydroxyalkyl group, for example methyl, ethyl, propyl, hydroxyethyl, and the like, poly($C_{2-3}$ alkoxy), polyethoxy, benzyl, or mixtures thereof; each Z is independently $(CH_2)n$, CH2-CH(CH3)- or CH—(CH3)-CH2-; each Y may comprise —O—(O)C—, —C(O)—O—, —NR—C(O)—, or —C(O)—NR—; each m is 2 or 3; each n is from 1 to about 4, in one aspect 2; the sum of carbons in each $R^1$, plus one when Y is —O—(O)C— or —NR—C(O)—, may be $C_{12}$-$C_{22}$, or $C_{14}$-$C_{20}$, with each $R^1$ being a hydrocarbyl, or substituted hydrocarbyl group; and $X^-$ may comprise any softener-compatible anion. In one aspect, the softener-compatible anion may comprise chloride, bromide, methylsulfate, ethylsulfate, sulfate, and nitrate. In another aspect, the softener-compatible anion may comprise chloride or methyl sulfate. As used herein, when the diester is specified, it can include the monoester that is present.

Film-Forming Water-Soluble Polymer

The article comprises at least one film-forming water-soluble polymer. As used herein, the term "film-forming water-soluble polymer" is broad enough to include both water-soluble and water-dispersible polymers, and is defined as a polymer with a solubility in water, measured at 25° C., of at least about 0.1 gram/liter (g/L). In some embodiments, the polymers have solubility in water, measured at 25° C., of from about 0.1 gram/liter (g/L). to about 500 grams/liter (g/L). (This indicates production of a macroscopically isotropic or transparent, colored or colorless solution). The polymers for making these solids may be of synthetic or natural origin and may be modified by means of chemical reactions; they may or may not be film-forming.

The one or more water-soluble polymers of the present invention are selected such that their weight-average molecular weight is from about 10,000 to about 500,000 Da, in one embodiment from about 50,000 to about 400,000 Da, in yet another embodiment from about 60,000 to about 300,000 Da, and in still another embodiment from about 70,000 to about 200,000 Da. The weight-average molecular weight is computed by summing the average molecular weights of each polymer raw material multiplied by their respective relative weight percentages by weight of the total weight of polymers present within the porous solid.

In one embodiment, at least one of the one or more film-forming water-soluble polymers is chosen such that a 2% by weight solution of the water-soluble polymer gives a viscosity at 20° C. of from about 4 centipoise to about 80 centipoise; in an alternate embodiment from about 5 centipoise to about 70 centipoise; and in another embodiment from about 6 centipoise to about 60 centipoise.

The film-forming water-soluble polymer may be present in some embodiments of the present invention at from about 5 wt % to about 60 wt % by weight of the article of one or more water-soluble polymer, in some embodiments from about 10 wt % to about 40 wt %, and in some embodiments from about 15 wt % to about 30 wt % by weight of the article of one or more water-soluble polymers.

The film-forming water-soluble polymer(s) and copolymers or derivatives thereof suitable for use as water-soluble material of the present invention can include, but are not limited to polyvinyl alcohols (PVA), modified PVAs; polyvinyl pyrrolidone; PVA copolymers such as PVA/polyvinyl pyrrolidone and PVA/polyvinyl amine; partially hydrolyzed polyvinyl acetate; polyalkylene oxides such as polyethylene oxide; polyacrylamide; polyacrylic acid; cellulose, alkyl cellulosics such as methyl cellulose, ethyl cellulose and propyl cellulose; carboxymethycelluloses; cellulose ethers; cellulose esters; cellulose amides; polyvinyl acetates; polycarboxylic acids and salts; polyaminoacids or peptides; polyamides; polyacrylamide; copolymers of maleic/acrylic acids; water soluble polyacrylates, caprolactams, polymethylmethacrylates, polymethylacrylamides, polydimethylacrylamides, polyethylene glycol monomethacrylates, polyurethanes, polyesters, polyamines, polyethyleneimines, maleic/(acrylate or methacrylate) copolymers, copolymers of methylvinyl ether and of maleic anhydride, copolymers of vinyl acetate and crotonic acid, copolymers of vinylpyrrolidone and of vinyl acetate, copolymers of vinylpyrrolidone and of caprolactam, vinyl pyrollidone/vinyl acetate copolymers, copolymers of anionic, cationic and amphoteric monomers, and combinations thereof.

The film-forming water-soluble polymer(s) which are suitable may also be selected from naturally sourced polymers including starch, modified starch; gelatin; alginates; xyloglucans, other hemicellulosic polysaccharides including xylan, glucuronoxylan, arabinoxylan, mannan, glucomannan and galactoglucomannan; and natural gums such as pectin, xanthan, and carrageenan, locus bean, arabic, tragacanth; karaya gum, tragacanth gum, gum Arabic, acemannan, konjac mannan, acacia gum, gum ghatti, whey protein isolate, and soy protein isolate; seed extracts including guar gum, locust bean gum, quince seed, and psyllium seed; seaweed extracts such as Carrageenan, alginates, and agar; fruit extracts (pectins); those of microbial origin including xanthan gum, gellan gum, pullulan, hyaluronic acid, chondroitin sulfate, and dextran; and those of animal origin including casein, gelatin, keratin, keratin hydrolysates, sulfonic keratins, albumin, collagen, glutelin, glucagons, gluten, zein, and shellac and combinations thereof.

Modified natural polymers are also useful as film-forming water-soluble polymer(s) in the present invention. Suitable modified natural polymers include, but are not limited to, cellulose derivatives such as hydroxypropylmethylcellulose, hydroxymethylcellulose, hydroxyethylcellulose, methylcellulose, hydroxypropylcellulose, ethylcellulose, carboxymethylcellulose, cellulose acetate phthalate, nitrocellulose and other cellulose ethers/esters; and guar derivatives such as hydroxypropyl guar.

Preferred film-forming water-soluble polymers of the present invention include polyvinyl alcohols, polyvinylpyrrolidones, polyalkylene oxides, starch and starch derivatives, pullulan, gelatin, hydroxypropylmethylcelluloses, methycelluloses, and carboxymethycelluloses.

More preferred film-forming water-soluble polymers of the present invention include polyvinyl alcohols, and hydroxypropylmethylcelluloses. Suitable polyvinyl alcohols include those available from Celanese Corporation (Dallas, Tex.) under the CELVOL® trade name. Suitable hydroxypropylmethylcelluloses include those available from the Dow Chemical Company (Midland, Mich.) under the METHO- CEL® trade name including combinations with above mentioned hydroxypropylmethylcelluloses.

Plasticizer

The article comprises a water soluble plasticizing agent suitable for use in compositions discussed herein. Non-limiting examples of suitable plasticizing agents include polyols, copolyols, polycarboxylic acids, esters and polyesters and dimethicone copolyols.

Examples of useful polyols include, but are not limited to, glycerol, diglycerol, propylene glycol, trimethylene glycol, tetramethylene glycol, pentamethylene glycol, hexamethylene glycol, ethylene glycol, diethylene glycol, triethylene glycol, butylene glycol, pentylene glycol, cyclohexane dimethanol, dipropylene glycol n-butyl ether, 1,2 propanediol; 1,3 propanediol; 2,3-butanediol; 1,4-butanediol; 1,3-butanediol; 1,5-pentanediol; 1,6 hexanediol; dipropylene glycol; 1,2,3-propanetriol; 2-methyl 1,3-propanediol; hexylene glycol; 1,2-hexanediol; 1,2-pentanediol; 1,2-butanediol; 1,4-cyclohexanedimethanol; pinacol; 2,4-dimethyl-2,4-pentanediol; 2,2,4-trimethyl-1,3-pentanediol; ethoxylates of 2,2,4-trimethyl-1,3-pentanediol; 2-ethyl-1,3-hexanediol; phenoxyethanol; butyl carbitol; triethanolamine; 1,4-cyclohexanedimethanol; pinacol; 2,4-dimethyl-2,4-pentanediol; 2,2,4-trimethyl-1,3-pentanediol; ethoxylates of 2,2,4-trimethyl-1,3-pentanediol; polyethylene glycols (200-600), alcohols such as ethanol; propanol; isopropanol; n-propanol; n-butanol; t-butanol; phenylethyl alcohol; sugar alcohols such as sorbitol, manitol, lactitol and other mono- and polyhydric low molecular weight alcohols (e.g., $C_2$-$C_8$ alcohols); mono di- and oligo-saccharides such as fructose, glucose, sucrose, maltose, lactose, and high fructose corn syrup solids and ascorbic acid.

Examples of polycarboxylic acids include, but are not limited to citric acid, maleic acid, succinic acid, polyacrylic acid, and polymaleic acid.

Examples of suitable esters include, but are not limited to, glycerol triacetate, acetylated-monoglyceride, diethyl phthalate, triethyl citrate, tributyl citrate, acetyl triethyl citrate, acetyl tributyl citrate triethanolamine acetate; ethanol acetamide; sodium citrate; trioctyl citrate.

Examples of suitable dimethicone copolyols include, but are not limited to, PEG-12 dimethicone, PEG/PPG-18/18 dimethicone, and PPG-12 dimethicone.

Other suitable plasticizers include, but are not limited to, ethanol acetamide; propylene carbonate; glycerin carbonate; ethylene carbonate; alkyl and allyl phthalates; napthalates; lactates (e.g., sodium, ammonium and potassium salts); sorbeth-30; urea; lactic acid; sodium pyrrolidone carboxylic acid (PCA); sodium hyraluronate or hyaluronic acid; soluble collagen; modified protein; monosodium L-glutamate; alpha & beta hydroxyl acids such as glycolic acid, lactic acid, citric acid, maleic acid and salicylic acid; glyceryl polymethacrylate; polymeric plasticizers such as polyquaterniums; proteins and amino acids such as glutamic acid, aspartic acid, and lysine; hydrogen starch hydrolysates; other low molecular weight esters (e.g., esters of $C_2$-$C_{10}$ alcohols and acids); and any other water soluble plasticizer known to one skilled in the art of the foods and plastics industries; and mixtures thereof.

Preferred plasticizers include glycerin and propylene glycol. EP 0283165 B1 discloses other suitable plasticizers, including glycerol derivatives such as propoxylated glycerol.

The plasticizer, may be present from 0 wt % to about 25 wt %, by weight of the article of a plasticizer, alternatively from about 5 wt % to about 20 wt %, in one embodiment from about 8 wt % to about 20 wt %, and in another embodiment from about 15 wt % to about 20 wt % by weight of the article of a plasticizer.

Surfactant

The article comprises one or more surfactants suitable for use in a liquid fabric conditioning composition. Surfactants suitable for use in the article include nonionic surfactants anionic surfactants, cationic surfactants, zwitterionic surfactants, amphoteric surfactants, or combinations thereof.

The one or more surfactants may be present from about 0 wt % to about 25 wt % by weight of the article of surfactant, in one embodiment from about 5 wt % to about 20 wt %, and in another embodiment from about 10 wt % to about 18 wt % by weight of the article of surfactant.

The surfactant component may also include surfactants that are intended primarily as a process aid in making a stable foam structure. Examples of emulsifiers for use as a surfactant component herein include mono- and di-glycerides, fatty alcohols, polyglycerol esters, propylene glycol esters, sorbitan esters and other emulsifiers known or otherwise commonly used to stabilized air interfaces.

Surfactants suitable include those described in McCutcheon's Detergents and Emulsifiers, North American Edition (1986), Allured Publishing Corp.; McCutcheon's, Functional Materials, North American Edition (1992), Allured Publishing Corp.; and U.S. Pat. No. 3,929,678 (Laughlin et al, U.S. patent application Ser. No. 12/361,634 and PCT Int Appl WO 2009095891.

Suitable nonionic surfactants include those described in McCutcheion's Detergents and Emulsifiers, North American edition (1986), Allured Publishing Corp., and McCutcheion's Functional Materials, North American edition (1992). These nonionic surfactants suitable for use herein include alkyl glucosides, alkyl polyglucosides, polyhydroxy fatty acid amides, alkoxylated fatty acid esters, sucrose esters, amine oxides, and combinations thereof.

Suitable nonionic surfactants for use in the personal care compositions of the present invention include, but are not limited to, polyoxyethylenated alkyl phenols, polyoxyethylenated alcohols, polyoxyethylenated polyoxypropylene glycols, glyceryl esters of alkanoic acids, polyglyceryl esters of alkanoic acids, propylene glycol esters of alkanoic acids, sorbitol esters of alkanoic acids, polyoxyethylenated sorbitol esters of alkanoic acids, polyoxyethylene glycol esters of alkanoic acids, polyoxyethylenated alkanoic acids, alkanolamides, N-alkylpyrrolidones, alkyl glycosides, alkyl polyglucosides, alkylamine oxides, and polyoxyethylenated silicones.

Representative polyoxyethylenated alcohols include alkyl chains ranging in the C9-C16 range and having from about 1 to about 110 alkoxy groups including, but not limited to, laureth-3, laureth-23, ceteth-10, steareth-10, steareth-100, beheneth-10, and commercially available from Shell Chemicals, Houston, Tex. under the trade names Neodol® 91, Neodol® 23, Neodol® 25, Neodol® 45, Neodol® 135, Neodo®167, Neodol® PC 100, Neodol® PC 200, Neodol® PC 600, and mixtures thereof.

Also available commercially are the polyoxyethylene fatty ethers available commercially under the Brij® trade name from Uniqema, Wilmington, Del., including, but not limited to, Brij® 30, Brij® 35, Brij® 52, Brij® 56, Brij® 58, Brij® 72, Brij® 76, Brij® 78, Brij® 93, Brij® 97, Brij® 98, Brij® 721 and mixtures thereof.

Suitable alkyl glycosides and alkyl polyglucosides can be represented by the formula (S)n—O—R wherein S is a sugar moiety such as glucose, fructose, mannose, galactose, and the like; n is an integer of from about 1 to about 1000, and R is a C8-C30 alkyl group. Examples of long chain alcohols from which the alkyl group can be derived include decyl alcohol, lauryl alcohol, myristyl alcohol, cetyl alcohol, stearyl alcohol, oleyl alcohol, and the like. Examples of these surfactants include alkyl polyglucosides wherein S is a glucose moiety, R is a C8-20 alkyl group, and n is an integer of from about 1 to about 9. Commercially available examples of these surfactants include decyl polyglucoside and lauryl polyglucoside available under trade names APG® 325 CS, APG® 600 CS and APG® 625 CS) from Cognis, Ambler, Pa. Also useful herein are sucrose ester surfactants such as sucrose cocoate and sucrose laurate and alkyl polyglucosides available under trade names Triton™ BG-10 and Triton™ CG-110 from The Dow Chemical Company, Houston, Tx.

Other nonionic surfactants suitable for use in the present invention are glyceryl esters and polyglyceryl esters, including but not limited to, glyceryl monoesters, glyceryl monoesters of C12-22 saturated, unsaturated and branched chain fatty acids such as glyceryl oleate, glyceryl monostearate, glyceryl monopalmitate, glyceryl monobehenate, and mixtures thereof, and polyglyceryl esters of C12-22 saturated, unsaturated and branched chain fatty acids, such as polyglyceryl-4 isostearate, polyglyceryl-3 oleate, polyglyceryl-2-sesquioleate, triglyceryl diisostearate, diglyceryl monooleate, tetraglyceryl monooleate, and mixtures thereof.

Also useful herein as nonionic surfactants are sorbitan esters. Sorbitan esters of C12-22 saturated, unsaturated, and branched chain fatty acids are useful herein. These sorbitan esters usually comprise mixtures of mono-, di-, tri-, etc. esters. Representative examples of suitable sorbitan esters include sorbitan monolaurate (SPAN® 20), sorbitan monopalmitate (SPAN® 40), sorbitan monostearate (SPAN® 60), sorbitan tristearate (SPAN® 65), sorbitan monooleate (SPAN® 80), sorbitan trioleate (SPAN® 85), and sorbitan isostearate.

Also suitable for use herein are alkoxylated derivatives of sorbitan esters including, but not limited to, polyoxyethylene (20) sorbitan monolaurate (Tween® 20), polyoxyethylene (20) sorbitan monopalmitate (Tween® 40), polyoxyethylene (20) sorbitan monostearate (Tween® 60), polyoxyethylene (20) sorbitan monooleate (Tween® 80), polyoxyethylene (4) sorbitan monolaurate (Tween® 21), polyoxyethylene (4) sorbitan monostearate (Tween® 61), polyoxyethylene (5) sorbitan monooleate (Tween® 81), and mixtures thereof, all available from Uniqema.

Also suitable for use herein are alkylphenol ethoxylates including, but not limited to, nonylphenol ethoxylates (Tergitol™ NP-4, NP-6, NP-7, NP-8, NP-9, NP-10, NP-11, NP-12, NP-13, NP-15, NP-30, NP-40, NP-50, NP-55, NP-70 available from The Dow Chemical Company, Houston, Tex.) and octylphenol ethoxylates (Triton™ X-15, X-35, X-45, X-114, X-100, X-102, X-165, X-305, X-405, X-705 available from The Dow Chemical Company, Houston, Tex.).

Also suitable for use herein are alkanolamides including cocamide monoethanolamine (CMEA) and tertiary alkylamine oxides including lauramine oxide and cocamine oxide.

Nonionic surfactants useful herein have an HLB (hydrophile-lipophile balance) of at least 8, in one embodiment greater than 10, and in another embodiment greater than 12. The HLB represents the balance between the hydrophilic and lipophilic moieties in a surfactant molecule and is commonly used as a method of classification. The HLB values for commonly-used surfactants are readily available in the literature (e.g., HLB Index in McCutcheon's Emulsifiers and Detergents, MC Publishing Co., 2004).

Water

Raw materials used to prepare the porous dissolvable solid structure may contain water as received from the supplier. The water soluble polymer and plasticizer are hygroscopic and care must be taken to protect these materials from absorbing water in the presence of humid air. Calculations for solids content and activity are performed using the information that is provided on the certificates of analyses provided by the supplier. Water may be added to the composition as a viscosity modifier during the making of the dissolvable porous substrates either before, or during the aeration step.

Optional Components

The article may further comprise optional components that are known for use or otherwise useful in fabric care compositions, provided that such optional materials are compatible with the selected essential materials described herein, or do not otherwise unduly impair product performance.

Deposition Aid

In one aspect, the dissolvable dissolvable porous substrate may comprise from about 0.01% to about 20%, from about 0.1 to about 15%, or from about 0.2 to about 10% of a deposition aid. Suitable deposition aids are disclosed in, for example, U.S. Ser. No. 12/080,358.

In one aspect, the deposition aid may be a cationic or amphoteric polymer. In one aspect, the deposition aid may be a cationic polymer. Cationic polymers in general and their method of manufacture are known in the literature. In one aspect, the cationic polymer may have a cationic charge density of from about 0.005 to about 23, from about 0.01 to about 12, or from about 0.1 to about 7 milliequivalents/g, at the pH of intended use of the composition. For amine-containing polymers, wherein the charge density depends on the pH of the composition, charge density is measured at the intended use pH of the product. Such pH will generally range from about 2 to about 11, more generally from about 2.5 to about 9.5. Charge density is calculated by dividing the number of net charges per repeating unit by the molecular weight of the repeating unit. The positive charges may be located on the backbone of the polymers and/or the side chains of polymers.

One group of suitable cationic polymers includes those produced by polymerization of ethylenically unsaturated monomers using a suitable initiator or catalyst, such as those disclosed in WO 00/56849 and U.S. Pat. No. 6,642,200.

Suitable polymers may be selected from the group consisting of cationic or amphoteric polysaccharide, polyethylene imine and its derivatives, and a synthetic polymer made by polymerizing one or more cationic monomers selected from the group consisting of N,N-dialkylaminoalkyl acrylate, N,N-dialkylaminoalkyl methacrylate, N,N-dialkylaminoalkyl acrylamide, N,N-dialkylaminoalkylmethacrylamide, quaternized N,N dialkylaminoalkyl acrylate quaternized N,N-dialkylaminoalkyl methacrylate, quaternized N,N-dialkylaminoalkyl acrylamide, quaternized N,N-dialkylaminoalkylmethacrylamide, Methacryloamidopropyl-pentamethyl-1,3-propylene-2-ol-ammonium dichloride, N,N,N,N',N',N",N"-heptamethyl-N"-3-(1-oxo-2-methyl-2-propenyl) aminopropyl-9-oxo-8-azo-decane-1,4,10-triammonium trichloride, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and derivatives, acrylic acid, methacrylic acid, maleic acid, vinyl sulfonic acid, styrene sulfonic acid, acrylamidopropylmethane sulfonic acid (AMPS) and their salts. The polymer may optionally be branched or cross-linked by using branching and crosslinking monomers. Branching and crosslinking monomers include ethylene glycoldiacrylate divinylbenzene, and butadiene. A suitable polyethyleneimine useful herein is that sold under the tradename Lupasol® by BASF, AG, Lugwigschaefen, Germany.

In another aspect, the treatment composition may comprise an amphoteric deposition aid polymer so long as the polymer possesses a net positive charge. Said polymer may have a cationic charge density of about 0.05 to about 18 milliequivalents/g.

In another aspect, the deposition aid may be selected from the group consisting of cationic polysaccharide, polyethylene imine and its derivatives, poly(acrylamide-co-diallyldimethylammonium chloride), poly(acrylamide-methacrylamidopropyltrimethyl ammonium chloride), poly(acrylamide-co-N,N-dimethyl aminoethyl acrylate) and its quaternized derivatives, poly(acrylamide-co-N,N-dimethyl aminoethyl methacrylate) and its quaternized derivative, poly(hydroxyethylacrylate-co-dimethyl aminoethyl methacrylate), poly (hydroxpropylacrylate-co-dimethyl aminoethyl methacrylate), poly(hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid), poly(diallyldimethyl ammonium chloride), poly(vinylpyrrolidone-co-dimethylaminoethyl methacrylate), poly(ethyl methacrylate-co-quaternized dimethylaminoethyl methacrylate), poly(ethyl methacrylate-co-oleyl methacrylate-co-diethylaminoethyl methacrylate), poly(diallyldimethylammonium chloride-co-acrylic acid), poly(vinyl pyrrolidone-co-quaternized vinyl imidazole) and poly (acrylamide-co-Methacryloamidopropyl-pentamethyl-1,3-propylene-2-ol-ammonium dichloride), Suitable deposition aids include Polyquaternium-1, Polyquaternium-5, Polyquaternium-6, Polyquaternium-7, Polyquaternium-8, Polyquaternium-11, Polyquaternium-14, Polyquaternium-22, Polyquaternium-28, Polyquaternium-30, Polyquaternium-32 and Polyquaternium-33, as named under the International Nomenclature for Cosmetic Ingredients.

In one aspect, the deposition aid may comprise polyethyleneimine or a polyethyleneimine derivative. In another aspect, the deposition aid may comprise a cationic acrylic based polymer. In a further aspect, the deposition aid may comprise a cationic polyacrylamide. In another aspect, the deposition aid may comprise a polymer comprising polyacrylamide and polymethacrylamidopropyl trimethylammonium cation. In another aspect, the deposition aid may comprise poly(acrylamide-N-dimethyl aminoethyl acrylate) and its quaternized derivatives. In this aspect, the deposition aid may be that sold under the tradename Sedipur®, available from BTC Specialty Chemicals, a BASF Group, Florham Park, N.J. In a yet further aspect, the deposition aid may comprise poly(acrylamide-co-methacrylamidopropyltrimethyl ammonium chloride). In another aspect, the deposition aid may comprise a non-acrylamide based polymer, such as that sold under the tradename Rheovis® CDE, available from Ciba Specialty Chemicals, a BASF group, Florham Park, N.J., or as disclosed in USPA 2006/0252668. In another aspect the deposition aid may comprise copolymer of poly(vinyl alcohol) and poly(vinyl amine) such as that sold under the tradenames of Celvol SP L12, Celvol SP L6, Celvol SP M12, Celvol SP M6, from Celanese in Dallas, Tex.

In another aspect, the deposition aid may be selected from the group consisting of cationic or amphoteric polysaccharides. In one aspect, the deposition aid may be selected from the group consisting of cationic and amphoteric cellulose ethers, cationic or amphoteric galactomanan, cationic guar gum, cationic or amphoteric starch, and combinations thereof.

Another group of suitable cationic polymers may include alkylamine-epichlorohydrin polymers which are reaction products of amines and oligoamines with epicholorohydrin, for example, those polymers listed in, for example, U.S. Pat. Nos. 6,642,200 and 6,551,986. Examples include dimethylamine-epichlorohydrin-ethylenediamine, available under the trade name Cartafix® CB and Cartafix® TSF from Clariant, Basle, Switzerland.

Another group of suitable synthetic cationic polymers may include polyamidoamine-epichlorohydrin (PAE) resins of polyalkylenepolyamine with polycarboxylic acid. The most common PAE resins are the condensation products of diethylenetriamine with adipic acid followed by a subsequent reaction with epichlorohydrin. They are available from Hercules Inc. of Wilmington Del. under the trade name Kymene™ or from BASF AG (Ludwigshafen, Germany) under the trade name Luresin™. These polymers are described in Wet Strength resins and their applications edited by L. L. Chan, TAPPI Press (1994).

The cationic polymers may contain charge neutralizing anions such that the overall polymer is neutral under ambient conditions. Non-limiting examples of suitable counter ions (in addition to anionic species generated during use) include chloride, bromide, sulfate, methylsulfate, sulfonate, methylsulfonate, carbonate, bicarbonate, formate, acetate, citrate, nitrate, and mixtures thereof.

The weight-average molecular weight of the polymer may be from about 500 to about 5,000,000, or from about 1,000 to about 2,000,000, or from about 2,500 to about 1,500,000 Daltons, as determined by size exclusion chromatography relative to polyethyleneoxide standards with RI detection. In one aspect, the MW of the cationic polymer may be from about 500 to about 150,000 Daltons.

Organosilicone

The articles of the present invention may comprise organosilicones. Any suitable organosilicone is of use. Suitable organosilicones may comprise Si—O moieties and may be selected from (a) non-functionalized siloxane polymers, (b) functionalized siloxane polymers, and mixtures thereof. The molecular weight of the organosilicone is usually indicated by the reference to the viscosity of the material. In one aspect, the organosilicones may comprise a viscosity of from about 10 to about 2,000,000 centistokes at 25° C. In another aspect, suitable organosilicones may have a viscosity of from about 10 to about 800,000 centistokes at 25° C.

Suitable organosilicones may be linear, branched or cross-linked and suitable examples are described in U.S. Pat. Nos. 6,815,069; 7,153,924; 7,321,019; and 7,427,648; and U.S. PA 61/319,939. In one aspect, the organosilicones may be linear.

In one aspect, the organosilicone may comprise a non-functionalized siloxane polymer that may have Formula I below, and may comprise polyalkyl and/or phenyl silicone fluids, resins and/or gums.

$$[R_1R_2R_3SiO_{1/2}]_n[R_4R_4SiO_{2/2}]_m[R_4SiO_{3/2}]_j \quad \text{(Formula I)}$$

wherein:

i) each $R_1$, $R_2$, $R_3$ and $R_4$ may be independently selected from the group consisting of H, —OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy, moieties;

ii) n may be an integer from about 2 to about 10, or from about 2 to about 6; or 2; such that n=j+2;

iii) m may be an integer from about 5 to about 8,000, from about 7 to about 8,000 or from about 15 to about 4,000;

iv) j may be an integer from about 0 to about 10, or from about 0 to about 4, or 0;

In one aspect, $R_2$, $R_3$ and $R_4$ may comprise methyl, ethyl, propyl, $C_4$-$C_{20}$ alkyl, and/or $C_6$-$C_{20}$ aryl moieties. In one aspect, each of $R_2$, $R_3$ and $R_4$ may be methyl. Each $R_1$ moiety blocking the ends of the silicone chain may comprise a moiety selected from the group consisting of hydrogen, methyl, methoxy, ethoxy, hydroxy, propoxy, and/or aryloxy.

As used herein, the nomenclature SiO"n"/2 represents the ratio of oxygen and silicon atoms. For example, $SiO_{1/2}$ means that one oxygen is shared between two Si atoms Likewise $SiO_{2/2}$ means that two oxygen atoms are shared between two Si atoms and $SiO_{3/2}$ means that three oxygen atoms are shared are shared between two Si atoms.

In one aspect, the organosilicone may be polydimethylsiloxane, dimethicone, dimethiconol, dimethicone crosspolymer, phenyl trimethicone, alkyl dimethicone, lauryl dimethicone, stearyl dimethicone and phenyl dimethicone. Examples include those available under the trade names DC 200 Fluid, DC 1664, DC 349, DC 346G available from offered by Dow Corning Corporation, Midland, Mich., and those available under the trade names SF1202, SF1204, SF96, and Viscasil® available from Momentive Silicones, Waterford, N.Y.

In one aspect, the organosilicone may comprise a cyclic silicone. The cyclic silicone may comprise a cyclomethicone of the formula $[(CH_3)_2SiO]_n$ where n is an integer that may range from about 3 to about 7, or from about 5 to about 6.

In one aspect, the organosilicone may comprise a functionalized siloxane polymer. Functionalized siloxane polymers may comprise one or more functional moieties selected from the group consisting of amino, amido, alkoxy, hydroxy, polyether, carboxy, hydride, mercapto, sulfate phosphate, and/or quaternary ammonium moieties. These moieties may be attached directly to the siloxane backbone through a bivalent alkylene radical, (i.e., "pendant") or may be part of the backbone. Suitable functionalized siloxane polymers include materials selected from the group consisting of aminosilicones, amidosilicones, silicone polyethers, silicone-urethane polymers, quaternary ABn silicones, amino ABn silicones, and combinations thereof.

In one aspect, the functionalized siloxane polymer may comprise a silicone polyether, also referred to as "dimethicone copolyol." In general, silicone polyethers comprise a polydimethylsiloxane backbone with one or more polyoxyalkylene chains. The polyoxyalkylene moieties may be incorporated in the polymer as pendent chains or as terminal blocks. Such silicones are described in U.S. Patent Application No. 2005/0098759, and U.S. Pat. Nos. 4,818,421 and 3,299,112. Exemplary commercially available silicone polyethers include DC 190, DC 193, FF400, all available from Dow Corning Corporation, and various Silwet surfactants available from Momentive Silicones.

In another aspect, the functionalized siloxane polymer may comprise an aminosilicone. Suitable aminosilicones are described in U.S. Pat. Nos. 7,335,630 B2, 4,911,852, and USPA 2005/0170994A1. In one aspect the aminosilicone may be that described in U.S. PA 61/221,632. In another aspect, the aminosilicone may comprise the structure of Formula II:

$$[R_1R_2R_3SiO_{1/2}]_n[(R_4Si(X—Z)O_{2/2}]_k[R_4R_4SiO_{2/2}]_m [R_4SiO_{3/2}]_j \quad \text{(Formula II)}$$

wherein i) $R_1$, $R_2$, $R_3$ and $R_4$ may each be independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy;

ii) Each X may be independently selected from a divalent alkylene radical comprising 2-12 carbon atoms, —$(CH_2)_s$- wherein s may be an integer from about 2 to about 10; —$CH_2$—CH(OH)—$CH_2$—; and/or

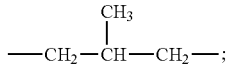

iii) Each Z may be independently selected from —$N(R_5)_2$; —$N(R_5)_3A^-$,

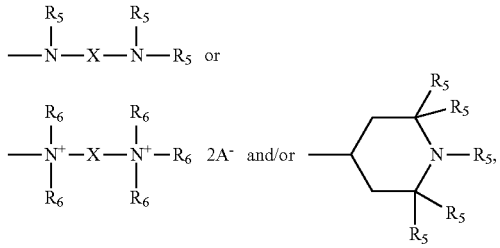

wherein each $R_5$ may be selected independently selected from H, $C_1$-$C_{20}$ alkyl, $C_1$-$C_{20}$ substituted alkyl, $C_6$-$C_{20}$ aryl, $C_6$-$C_{20}$ and/or substituted aryl, each $R_6$ may be independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy; and $A^-$ may be a compatible anion. In one aspect, $A^-$ may be a halide;

iv) k may be an integer from about 3 to about 20, preferably from about 5 to about 18 more preferably from about 5 to about 10;

v) m may be an integer from about 100 to about 2,000, or from about 150 to about 1,000;

vi) n may be an integer from about 2 to about 10, or about 2 to about 6, or 2, such that n=j+2; and vii) j may be an integer from about 0 to about 10, or from about 0 to about 4, or 0;

In one aspect, $R_1$ may comprise —OH. In this aspect, the organosilicone is amodimethicone.

Exemplary commercially available aminosilicones include DC 8822, 2-8177, and DC-949, available from Dow Corning Corporation, and KF-873, available from Shin-Etsu Silicones, Akron, Ohio.

In one aspect, the organosilicone may comprise amine ABn silicones and quat ABn silicones. Such organosilicones are generally produced by reacting a diamine with an epoxide. These are described, for example, in U.S. Pat. Nos. 6,903,061 B2, 5,981,681, 5,807,956, 6,903,061 and 7,273,837. These are commercially available under the trade names Magnasoft® Prime, Magnasoft® JSS, Silsoft® A-858 (all from Momentive Silicones).

In another aspect, the functionalized siloxane polymer may comprise silicone-urethanes, such as those described in U.S. Patent Application No. 61/170,150. These are commercially available from Wacker Silicones under the trade name SLM-21200.

When a sample of organosilicone is analyzed, it is recognized by the skilled artisan that such sample may have, on average, non-integer indices for Formula I and II above, but that such average indice values will be within the ranges of the indices for Formula I and II above.

Neat Perfumes and Perfume Delivery Systems

In some embodiments, the article comprises neat perfume and/or perfume delivery systems, each of which is discussed in further detail below. The neat perfume and/or perfume delivery system may be incorporated into the composition that is manipulated to form the porous, dissolvable solid structure. In addition or in the alternative, the neat perfume and/or perfume delivery system may be applied to the porous, dissolvable solid structure after it is formed. This step is discussed in the "Method of Manufacturing" section below.

Any suitable neat perfume may be of use in the article. Non-limiting examples of neat perfumes of use in fabric conditioning compositions are described in U.S. Patent Publication No. 2005/0192207A1.

Any suitable perfume delivery system may be of use in the article. Non-limiting examples of such systems are described in U.S. Patent Publication No. 2007/0275866A1 and include the following: starch encapsulated accord; perfume microcapsule; and perfume loaded zeolite.

Starch Encapsulated Accord

The use of starch encapsulated accord or "SEA", technology allows one to modify the properties of a perfume, for example, by converting a liquid perfume into a solid by adding components such as starch. The benefit includes increased perfume retention during product storage, especially under non-aqueous conditions. Upon exposure to moisture, a perfume bloom may be triggered. Benefits at other times may also be achieved because the starch allows the product formulator to select perfume raw material(s) concentrations that normally cannot be used without the presence of SEA. Another technology example includes the use of other organic and inorganic materials, such as silica to convert perfume from liquid to solid. Suitable SEAs as well as methods of making same may be found in U.S. Patent Publication No. 2005/0003980 A1 and U.S. Pat. No. 6,458,754 B1.

Perfume Microcapsule

For purposes of the present invention and unless indicated otherwise, the terms "perfume nanocapsule" and "microcapsule" are within the scope of the term "perfume microcapsule." Microcapsules of the current invention are formed by a variety of procedures that include, but are not limited to, coating, extrusion, spray-drying, interfacial, in-situ and matrix polymerization. The possible shell materials vary widely in their stability toward water. Among the most stable are polyoxymethyleneurea (PMU)-based materials, which may hold certain PRMs for even long periods of time in aqueous solution (or product). Such systems include but are not limited to urea-formaldehyde and/or melamine-formaldehyde. Gelatin-based microcapsules may be prepared so that they dissolve quickly or slowly in water, depending for example on the degree of cross-linking. Many other capsule wall materials are available and vary in the degree of perfume diffusion stability observed. Without wishing to be bound by theory, the rate of release of perfume from a capsule, for example, once deposited on a surface is typically in reverse order of in-product perfume diffusion stability. As such, urea-formaldehyde and melamine-formaldehyde microcapsules for example, typically require a release mechanism other than, or in addition to, diffusion for release, such as mechanical force (e.g., friction, pressure, shear stress) that serves to break the capsule and increase the rate of perfume (fragrance) release. Other triggers include melting, dissolution, hydrolysis or other chemical reaction, electromagnetic radiation, and the like. The use of pre-loaded microcapsules requires the proper ratio of in-product stability and in-use and/or on-surface (on-situs) release, as well as proper selection of PRMs. Microcapsules that are based on urea-formaldehyde and/or melamine-formaldehyde are relatively stable, especially in near neutral aqueous-based solutions. These materials may require a friction trigger which may not be applicable to all product applications. Other microcapsule materials (e.g., gelatin) may be unstable in aqueous-based products and may even provide reduced benefit (versus free perfume control) when in-product aged. Scratch and sniff technologies are yet another example of PAD. Perfume microcapsules (PMC) may include those described in the following references: U.S. Patent Application Nos.: 2003/0125222 A1; 2003/215417 A1; 2003/216488 A1; 2003/158344 A1; 2003/165692 A1; 2004/071742 A1; 2004/071746 A1; 2004/072719 A1; 2004/072720 A1; 2006/0039934 A1; 2003/203829 A1; 2003/195133 A1; 2004/087477 A1; 2004/0106536 A1; and U.S. Pat. Nos. 6,645,479 B1; 6,200,949 B1; 4,882,220; 4,917,920; 4,514,461; 6,106,875 and 4,234,627, 3,594,328 and U.S. RE 32713.

Perfume Loaded Zeolite

This technology relates to the use of porous zeolites or other inorganic materials to deliver perfumes. Perfume-loaded zeolite may be used with or without adjunct components used for example to coat the perfume-loaded zeolite (PLZ) to change its perfume release properties during product storage or during use or from the dry situs. Suitable zeolite and inorganic carriers as well as methods of making same may be found in U.S. Patent Application No. 2005/0003980 A1 and U.S. Pat. Nos. 5,858,959; 6,245,732 B1; 6,048,830 and 4,539,135. Silica is another form of ZIC. Another example of a suitable inorganic carrier includes inorganic tubules, where the perfume or other active material is contained within the lumen of the nano- or micro-tubules. Preferably, the perfume-loaded inorganic tubule (or Perfume-Loaded Tubule or PLT) is a mineral nano- or micro-tubule, such as halloysite or mixtures of halloysite with other inorganic materials, including other clays. The PLT technology may also comprise additional components on the inside and/or outside of the tubule for the purpose of improving in-product diffusion stability, deposition on the desired situs or for controlling the release rate of the loaded perfume. Monomeric and/or polymeric materials, including starch encapsulation, may be used to coat, plug, cap, or otherwise encapsulate the PLT. Suitable PLT systems as well as methods of making same may be found in U.S. Pat. No. 5,651,976.

Organic Solvents

Other optional components include organic solvents, especially water miscible solvents and co-solvents useful as solublizing agents for polymeric structurants and as drying accelerators. Non-limiting examples of suitable solvents include alcohols, esters, ketones, aromatic hydrocarbons, aliphatic hydrocarbons, ethers, and combinations thereof. Alcohols and esters are more preferred. Preferred alcohols are monohydric. The most preferred monohydric alcohols are ethanol, iso-propanol, and n-propanol. The most preferred esters are ethyl acetate and butyl acetate. Other non-limiting examples of suitable organic solvents are benzyl alcohol, amyl acetate, propyl acetate, acetone, heptane, iso-butyl acetate, iso-propyl acetate, toluene, methyl acetate, iso-butanol, n-amyl alcohol, n-butyl alcohol, hexane, and methyl ethyl ketone, methanol, ethanol, n-propanol, isopropanol, n-butanol, isobutanol, methylethylketone, acetone, and combinations thereof.

Additional Adjunct Ingredients

In another embodiment, the functionalized substrate further comprises additional adjunct ingredients. These additional adjunct ingredients can act as processing aids and modify substrate properties such as solubility and rate of dissolution, dissolution stability, resistance to moisture pickup from humidity in storage, stretchability, feel, brittleness, and texture of the substrate, appearance and shine, and ease and speed of processing, casting, extruding, or drying the substrate, mechanical handling of the substrate, and storage of the substrate. The water soluble polymers (for example, PVA with or without copolymers) may be further modified with various reagents commonly employed in the film preparation art such as plasticizers, surfactants, emulsifiers, non-film forming polymers, anti-block agents, antifoamers, defoamers, biocides, perfumes, preservatives, colorants, opacifiers, pearlescing agents, fillers and bulking agents, air or nitrogen, and the like.

Antifoam agents include the silicone polymers and silica, and defoamers include tallow compounds.

Useful biocides comprise any of the many known materials having efficacy against bacteria and other degrading organisms but which are non-toxic to handlers and to mammals or persons in the environment of use. Such agents and the principles of selection are well known to those skilled in the art. Suitable biocides include quaternary ammonium salts such as alkyl (C8-C18) di(lower alkyl)benzylammonium chloride, dialkyldimethylammonium bromide, and 1,2 benzisothiazolinon-3-one (BIT).

Other useful additives include mica, ethylene glycol distearate, talc, zeolites, cyclodextrins, clays, polyethylene, dispersions of polyethylene waxes, starch and starch derivatives, and cellulose and cellulose derivatives.

Additional additives suitable for use herein include: plasticizers, lubricants, release agents, fillers, extenders, anti-blocking agents, detackifying agents, antifoams, and other ingredients as disclosed in U.S. Pat. No. 6,787,512 at col. 6, line 25-col. 7, line 25.

In some embodiments, cleaning actives may be of use. Cleaning actives for use herein can include laundry cleaning actives, hard surface cleaning actives, hand or body soap cleaning actives, etc. Suitable cleaning actives include, but are not limited to, substances such as detersive surfactants (anionic, nonionic, cationic, zwitterionic, and amphoteric surfactants, and soaps), builders (inorganic and organic builder substances), bleaches, bleach activators, bleach stabilizers, bleach catalysts, enzymes, soil suspending or dispersing polymers, chelants, or combinations thereof, without the term being restricted to these substance groups. In one embodiment, the term "cleaning active" may be free or substantially free of one or more of the above identified actives. In one embodiment, the dissolvable porous solid comprises an encapsulated cleaning active and/or a free or unencapsulated cleaning active. In one embodiment, the cleaning active comprises a loading level as defined above.

Barrier agents perform a protective function. For example, they can protect mutually incompatible cleaning actives from one another, cleaning actives or solubility modifiers from the outside environment, the film from the external environment, etc. They can also modify the feeling at touch of the film and/or functional materials. They can make substrates more pleasant to the touch. Suitable barrier agents may include zeolite, bentonite, talc, mica, kaolin, silica, clay, hydrocarbons, silicone, starch, cyclodextrin, varnish, shellac, lacquer, polyolefins, paraffins, waxes, polyacrylates, polyurethanes, PVA, polyvinyl acetate, UV absorbers [see e.g., McCutcheon's Volume 2, Functional Materials, North American Edition, published by the Manufacturing Confectioner Publishing Company (1997)], fluorescent dyes, (see e.g., EP 1,141,207, U.S. Pat. No. 5,082,578), or combinations thereof.

In one embodiment, the functional composition may comprise one or more of the following material(s): soil release polymer, anti-oxidants, colorants, preservatives, optical brighteners, opacifiers, stabilizers such as guar gum and polyethylene glycol, anti-shrinkage agents, anti-wrinkle agents, soil release agents, fabric crisping agents, reductive agents, spotting agents, germicides, fungicides, anti-corrosion agents, antifoam agents, hueing dyes, and the like.

In one embodiment, the functional composition is free or substantially free of any one or more of the above-identified optional components.

In another embodiment the dissolvable porous solid comprises an aesthetic agent. The aesthetic agent can have ornamental purposes and can denote the presence of functional materials on the film. It can also signal when a functional material is released or a product "end of life" via a change in color and/or appearance/disappearance of graphics, patterns, trademarks, etc.

Product Form

The article can be produced in any of a variety of product forms, including dissolvable porous solids used alone or in combination with other fabric conditioning components. In some embodiments, the article is in the form of one or more flat sheets or pads of an adequate size to be able to be handled easily by the user. It may have a square, rectangle or disc shape or any other suitable shape. The pads can also be in the form of a continuous strip including delivered on a tape-like roll dispenser with individual portions dispensed via perforations and or a cutting mechanism. Alternatively, the articles may be in the form of one or more cylindrical objects, spherical objects, tubular objects or any other three-dimensionally shaped object.

The article may comprise one or more textured, dimpled or otherwise topographically patterned surfaces including letters, logos or figures. The textured substrate preferably results from the shape of the substrate, in that the outermost surface of the substrate contains portions that are raised with respect to other areas of the surface. The raised portions can result from the formed shape of the article, for example the article can be formed originally in a dimpled or waffle pattern. The raised portions can also be the result of creping processes, imprinted coatings, embossing patterns, laminating to other layers having raised portions, or the result of the physical form of the dissolvable porous solid substrate itself. The texturing can also be the result of laminating the substrate to a second substrate that is textured. One example of printing on the dissolvable porous substrate can be achieved using jet printing or ink-jet type printing. Such industrial printing techniques are known. See e.g., WO 03/091028 A1; WO 00/20157; U.S. Pat. No. 5,463,416. In one embodiment, the printing does not contact the film or substrate. This technique may prove useful when wishing not to disturb the film based on manufacturing efficiencies or simply because of the presence of embossings or other ornamental features on the film or substrate. Messages, ornamental designs, pictures, and the like may also be printed using methods such as those described in WO 2005/002360. In another embodiment, graphics may be printed in 2D or 3D with UV curable dye that is water-soluble or at least partially water-soluble.

In yet another embodiment, the functional composition is a powder or substantially a solid. In this embodiment, the powder or solid composition is printed onto the film or substrate.

In some embodiments, the article can be perforated with holes or channels penetrating into or through the porous solid. These perforations can be formed during the drying process via spikes extended from the surface of the underlying mold, belt or other non-stick surface. Alternatively, these perforations can be formed after the drying process via poking or sticking the porous solids with pins, needles or other sharp objects. In some embodiments, these perforations are great in number per surface area, but not so great in number so as to sacrifice the integrity or physical appearance of the porous solid. It has been found that such perforations may increase the dissolution rate of the porous solids into water relative to un-perforated porous solids.

In some embodiments, the article can be delivered via a water insoluble implement or device. In some embodiments, the article may be adsorbed to the surfaces a separate high surface area water-insoluble implement, i.e., a porous sponge, a puff, a flat sheet etc. For the latter, the dissolvable porous solid of the present invention may be adsorbed as a thin film or layer.

I. Method of Manufacture

Articles according to the present invention may be manufactured by a process comprising: (1) preparing a solution comprising water, water soluble polymer, plasticizer, diester quaternary ammonium compound and in some embodiments, optional components; (2) aerating the solution by introducing gas into the solution to form a wet aerated product; (3) forming the aerated wet aerated product into one or more shapes to form a shaped wet product; and (5) drying the shaped wet product to a desired Remaining Water content to form a porous dissolvable solid structure. One or more of the following optional steps may also be performed: (O-1) adding additional water to the second solution made in step (2) before aeration, during aeration and/or after aeration and prior to forming the aerated wet mixture; (O-2) cutting the porous dissolvable solid structure into a shape; (O-3) adding optional component(s) to the porous dissolvable structure.

(1) Preparing a First Solution

In some embodiments, a solution may be prepared by dissolving the water soluble polymer in the presence of water, plasticizer and in some embodiments, optional components by heating followed by cooling. In some embodiments, the solution may further comprise diester quaternary ammonium compound. In some embodiments, the solution may further comprise optional components including, but not limited to nonionic surfactant. The solution may be prepared using any suitable heated batch agitation system or any suitable continuous system involving either single screw or twin screw extrusion or heat exchangers together with either high shear or static mixing. Any process can be envisioned such that the polymer is ultimately dissolved in the presence of water, plasticizer, diester quaternary ammonium compound and in some embodiments, optional components, including stepwise processing via pre-mix portions of any combination of components.

In some embodiments, the first solution of the present invention comprises from about 5% to about 50% solids, in some embodiments from about 10% to about 45% solids, and in other embodiments from about 20% to about 40% solids, by weight of the processing mixture before drying; and has a viscosity of from about 2,500 cps to about 200,000 cps, in some embodiments from about 5,000 cps to about 180,000 cps, in some embodiments from about 7,500 cps to about 150,000 cps, and in some embodiments from about 10,000 cps to about 100,000 cps.

The % solids content is the summation of the weight percentages by weight of the total solution at issue of all of the solid, semi-solid and liquid components excluding water and any obviously volatile materials such as low boiling alcohols. The solution viscosity values are measured using a CPE 52 spindle on a Brookfield DV-1 Prime viscometer set to 0.5 rpm for a period of 60 seconds at 25° C.

(2) Aerating the Solution

The aeration of the solution to form a wet aerated product may be accomplished by introducing a gas into the solution, such as by mechanical mixing energy and or via chemical means. The aeration may be accomplished by any suitable mechanical processing means, including but not limited to: (i) Batch tank aeration via mechanical mixing including planetary mixers or other suitable mixing vessels, (ii) semi-continuous or continuous aerators utilized in the food industry (pressurized and non-pressurized), or (iii) spray-drying the processing mixture in order to form aerated beads or particles that can be compressed such as in a mould with heat in order to form the porous solid.

In some embodiments, the wet aerated product can be prepared within continuous pressurized aerators that are conventionally utilized within the foods industry in the production of marshmallows. Suitable continuous pressurized aerators include the Morton whisk (Morton Machine Co., Motherwell, Scotland), the Oakes continuous automatic mixer (E. T. Oakes Corporation, Hauppauge, N.Y.), the Fedco Continuous Mixer (The Peerless Group, Sidney, Ohio), and the Preswhip (Hosokawa Micron Group, Osaka, Japan).

(3) Forming the Wet Aerated Product

The second solution may be formed into the wet aerated product using any suitable means to form the mixture in a desired shape or shapes including, but not limited to (i) depositing the aerated second solution to moulds of the desired shape and size comprising a non-interacting and non-stick surface including, but not limited to aluminium, Teflon, metal, HDPE, polycarbonate, neoprene, rubber, LDPE, glass and the like; (ii) depositing the aerated second solution into cavities imprinted in dry granular starch contained in a shallow tray, otherwise known as starch moulding forming technique; and (iii) depositing the aerated second solution onto a continuous belt or screen comprising any non-interacting or non-stick material Teflon, metal, HDPE, polycarbonate, neoprene, rubber, LDPE, glass and the like which may be later stamped, cut, embossed or stored on a roll.

(4) Drying the Shaped Wet Product

The drying of the shaped wet product to form the porous dissolvable structure may be accomplished by any suitable means including, but not limited to utilization of (i) drying room(s) including rooms with controlled temperature and pressure or atmospheric conditions; (ii) ovens including non-convection or convection ovens with controlled temperature and optionally humidity; (iii) Truck/Tray driers, (iv) multi-stage inline driers; (v) impingement ovens; (vi) rotary ovens/driers; (vii) inline roasters; (viii) rapid high heat transfer ovens and driers; (ix) dual plenum roasters, (x) conveyor driers and any combination thereof.

Optional components may be imparted during any of the above described four processing steps or even after the drying process.

The article may also be prepared with chemical foaming agents by in-situ gas formation (via chemical reaction of one or more components, including formation of $CO_2$ by an effervescent system).

(O-1) Adding Additional Water to the Second Solution

In some embodiments, the process of the present invention comprises the step of adding additional water to the second solution. Water may be added before, during and/or after the second solution is aerated by introducing gas thereto.

(O-2) Cutting the Porous Dissolvable Solid Structure

In some embodiments, the process of the present invention comprises the step of cutting the porous dissolvable solid structure into one or more shapes. This may be accomplished using any suitable means.

(O-3) Adding Optional Components

In some embodiments, the process of the present invention comprises the step of adding optional components to the porous dissolvable structure. This may be accomplished using any suitable means. Non-limiting examples of such means include spray-drying, powdering, dipping, coating and any combination thereof.

(O-4) Means of Molding (Injection and Casting into a Mold)

In some embodiments, the process of the present invention comprises the step of forming the wet composition into a molded shape by means of injection molding, extrusion, or casting onto a continuous belt or screen which may be later stamped, cut, embossed or stored on a roll, or casting onto a continuous belt that has been imprinted with cavities to result in a moulded shape.

II. Physical Characteristics

Dissolution Rate

The article has a Dissolution Rate that allows the porous solid to rapidly disintegrate during use application with water. The Dissolution Rate of the article is determined in accordance with the methodology described below.

Conductivity Dissolution Method: In a 500 ml beaker, 300 grams of distilled water is weighed at room temperature. The beaker is placed on an orbital shaker, for example a VWR model DS-500E and started at 150 RPM. A conductivity probe, for example a VWR model 2052 connected to a VWR conductivity meter, is submerged just below the surface of the water in such a manner that the conductivity probe remains stationary in relation to the motion of the beaker and never touches the side of the beaker. A 0.20+/−0.01 grams of the dissolvable porous solid is weighed and placed into the water. Conductivity data is recorded every 15 seconds for 6 minutes, and then once a minute until 30 minutes. The final value is recorded when the conductivity values stopped changing or 30 minutes is reached, which ever is earlier. The conductivity dissolution time is taken as the time it takes in seconds until the conductivity values stop changing or as the maximum of 30 minutes, which ever happens first.

The article has a conductivity dissolution time of from about 100 seconds to about 2,000 seconds, in another embodiment from about 200 seconds to about 1000 seconds, in yet another embodiment from about 250 seconds to about 600 seconds, and in still another embodiment from about 200 seconds to about 400 seconds.

Distance to Maximum Force Method

The distance to maximum force is measured via a Rupture Method on a Texture Analyzer using a TA-57R cylindrical probe with Texture Exponent 32 Software. The Article should have a thickness of between 4 to 7 mm and cut in a circle with a diameter of at least 7 mm for this method; or carefully cut or stacked to be within this overall thickness and diameter range. The porous solid sample is carefully mounted on top of the cylinder with four screws mounted on top with the top lid affixed in place on top of the sample. There is a hole in the center of the cylinder and its lid which allows the probe to pass through and stretch the sample. The sample is measured with a pre-test speed of 1 mm per second, a test speed of 2 mm per second and a post test speed of 3 mm per second over a total distance of 30 mm. The distance to maximum force is recorded.

Methods of Use

The articles of the present invention have a multitude of applications and methods of use. One application for functional substrates described herein is in the field of fabric care. One is a method of dispensing fabric softening active by contacting the porous substrate with an aqueous solution; at least partially dissolving the substrate; thereby releasing the fabric softening active. Another is a method of dispensing an encapsulated perfume comprising: contacting an article according to the present invention with an aqueous solution; at least partially dissolving the article; thereby releasing at least one encapsulated functional material (e.g. perfume) from the article. In one embodiment, said aqueous medium is the wash and/or rinse water in the basin of an automatic or manual laundry washing machine. Another suitable method of use further comprises, the step of contacting the article with an aqueous solution comprising at least partially immersing said article in said aqueous solution, such as from the wash cycle and/or a rinse cycle of a laundering process. Another suitable method of use provides for administering the article in the dryer. Yet another method of use is administering the article into a tub, basin, bucket or container in hand laundering situations, in the hand washing step, rinsing step or both.

In some embodiments, where a laundry bath solution is prepared by dispensing one or more articles into an aqueous solution (for pre-soak, wash and/or rinse cycle solutions prepared in an automated washing machine, manual washing device, tub or other container) the laundry bath solution comprises from about 0.1 ppm and about 3000 ppm of the article. Further, conventional detergent and/or fabric softener with perfume can also be used. In another embodiment, an unscented detergents and/or fabric softeners can be used.

In instances in which the article is to be dispensed into a rinse bath solution, but dispensing is desired at the beginning of the wash cycle, the article may be placed in dispensing means for delayed dispensing. Dispensing means may include the dispensing devices that are built into commercially available washing machines such as dispensing drawers and top loaded agitator dispensers. Likewise, the dispensing means may also include self-contained dispensing devices that may be placed in the tub of the machine at the start of the wash cycle (one example is the Downy® Ball). Suitable self-contained dispensing devices that are useful in the methods of the present invention are those that are designed to open during the spin cycle that follows the wash and precedes the rinse cycle. When a self-contained dispensing device is used to dispense an article, water may be added to the dispenser to aid in the dissolution and dispensing of the fabric care composition, i.e. between about 5 ml and about 150 ml of water and/or liquid fabric softener is added to the self-contained device Article of Commerce The present invention provides for an article of commerce comprising one or more articles described herein, and a communication directing a consumer to dissolve the porous dissolvable solid structure in water via a dispenser or via direct addition to the water by the consumer. The communication may be printed material attached directly or indirectly to packaging that contains the article or may be printed on the article itself. Alternatively, the communication may be an electronic or a broadcast message that is associated with the article of manufacture. Alternatively, the communication may describe at least one possible use, capability, distinguishing feature and/or property of the article of manufacture.

EXAMPLES

The following examples further describe and demonstrate embodiments within the scope of the present invention. The examples are given solely for the purpose of illustration and are not to be construed as limitations of the present invention, as many variations thereof are possible without departing from the spirit and scope of the invention. All exemplified amounts are concentrations by weight of the total composition, i.e., wt/wt percentages, unless otherwise specified.

Example 1

Polyvinyl Alcohol and Glycerin Solution

The following polymer solution compositions were prepared for use during the preparation of the dissolvable porous solids of the present invention:

| Component | Ex. 1A Wt % | Ex. 1B Wt % |
|---|---|---|
| Polyvinyl alcohol[a] | 22.00 | 14.00 |
| Glycerin | 7.33 | 15.50 |
| Distilled water | 70.67 | 70.50 |
| Total | 100.00 | 100.00 |

[a]87-89% hydrolyzed, MW 85,000 to 124,000 available from Sigma Aldrich (Catalog Number 363081)

Into an appropriately sized and cleaned vessel, the distilled water and glycerin is added with stifling at 100-300 rpm. The polyvinyl alcohol is weighed into a suitable container and slowly added to the main mixture in small increments using a spatula while continuing to stir while avoiding the formation of visible lumps. The mixing speed is adjusted to minimize foam formation. The mixture is slowly heated to 82° C. while continuing to stir, and is heated at 82° C. for at least 30 min. The mixing vessel is covered to minimize evaporation.

Example 2

Dissolvable Porous Solid Fabric Conditioners Prepared from a Retail Liquid Fabric Softening Product (Downy Ultra April Fresh)

The following dissolving porous solid is prepared in accordance to the present invention:

| Component | Wt % |
|---|---|
| Polyvinyl alcohol premix from Example 1A | 51.35 |
| Retail Downy Ultra April Fresh | 44.40 |
| Tween-60[a] | 4.25 |
| Total | 100.0 |

[a]Available from Sigma, catalog number P1629.

The above composition is prepared by mixing via a SpeedMixer™ DAC 400 FV available from FlackTek, Inc., Landrum, S.C. 250 grams of the above components in the given amounts are added into a Max 300 SpeedMixer™ plastic jar with all components being at room temperature. The mixture is thoroughly mixed within the SpeedMixer™ which is run at a rage of approximately 2,750 rpm for a time period of at least 30 seconds.

This mixture is transferred into a 5 quart stainless steel bowl of a KitchenAid® Mixer Model K5SS (available from Hobart Corporation, Troy, Ohio) and is preheated to 80° C. using a convection oven. The mixer is fitted with a flat beater attachment and the filled bowl is kept warm using boiling water in an external bath while the mixture is vigorously aerated at high speed for approximately 6 minutes. The resulting aerated mixture is then spread evenly with a spatula into circular Teflon molds (using rubber spatulas straight edge to scrape off excess foam leaving a flat smooth surface level with the top of the mold) with a 4.15 cm diameter and a depth of 1.4 cm which are weighed before and after with average wet mixture weights of 10.12 grams indicating an average wet foam density of approximately 0.535 grams/$cm^3$.

The aerated mixture is then transferred to aluminum molds with dimensions of 16 cm×16 cm×0.75 cm that have been pretreated with Poly-Tergent SLF-18 (ex BASF) for mold release. The filled molds are then placed into a 135° C. convection oven for 1 h, are removed from the oven for cooling. Once cool, the molds containing the dried mixture are weighed with subtraction of the original mold weights indicating dry weights of 26.83 g grams. The resulting porous solids are removed from the molds and the thicknesses are measured with a caliper giving 5.7 mm indicating an average resulting dry density of approximately 0.18 grams/$cm^3$ and with an average basis weight of 1050 grams per square meter (gsm).

Example 3

Dissolvable Porous Solid Fabric Conditioners Prepared from a Retail Liquid Fabric Softening Product (Downy Simple Pleasures Amethyst Mist)

The following dissolving porous solid is prepared in accordance to the present invention:

| Component | Wt % |
|---|---|
| Polyvinyl alcohol premix from Example 1A | 49.18 |
| Retail Downy Simple Pleasures Amethyst Mist | 45.92 |
| Tween-60[a] | 4.90 |
| Total | 100.0 |

[a]Available from Sigma, catalog number P1629.

The above composition is prepared by mixing via a SpeedMixer™ DAC 400 FV available from FlackTek, Inc., Landrum, S.C. 250 grams of the above components in the given amounts are added into a Max 300 SpeedMixer™ plastic jar with all components being at room temperature. The mixture is thoroughly mixed within the SpeedMixer™ which is run at a rage of approximately 2,750 rpm for a time period of at least 30 seconds.

This mixture is transferred into a 5 quart stainless steel bowl of a KitchenAid® Mixer Model K5SS (available from Hobart Corporation, Troy, Ohio) and is preheated to 80° C. using a convection oven. The mixer is fitted with a flat beater attachment and the filled bowl is kept warm using boiling water in an external bath while the mixture is vigorously aerated at high speed for approximately 6 minutes. The resulting aerated mixture is then spread evenly with a spatula into circular Teflon molds (using rubber spatulas straight edge to scrape off excess foam leaving a flat smooth surface level with the top of the mold) with a 4.15 cm diameter and a depth of 1.4 cm which are weighed before and after with average wet mixture weights of 7.68 grams indicating an average wet foam density of approximately 0.406 grams/cm$^3$.

The aerated mixture is then transferred to aluminum molds with dimensions of 16 cm×16 cm×0.75 cm that have been pretreated with Poly-Tergent SLF-18 (ex BASF) for mold release. The filled molds are then placed into a 135° C. convection oven for 30 min, are removed from the oven for cooling. Once cool, the molds containing the dried mixture are weighed with subtraction of the original mold weights indicating dry weights of 27.65 g grams. The resulting porous solids are removed from the molds and the thicknesses are measured with a caliper giving 4.0 mm indicating an average resulting dry density of approximately 0.270 grams/cm$^3$ and with an average basis weight of 1080 grams per square meter (gsm).

Example 4

Dissolvable Porous Solid Fabric Conditioners Prepared from a Diester Quaternary Ammonium Compound The following dissolving porous solid is prepared in accordance to the present invention:

| Component | Wt % |
|---|---|
| Polyvinyl alcohol premix from Example 1B | 50.9 |
| Tween-60[a] | 3.2 |
| DEEDMAC[b] | 15.9 |
| Water | 30.0 |
| Total | 100.0 |

[a]Available from Sigma, catalog number P1629.
[b]Rewoquat DEEDMAC available from Evonik Industries.

The above composition is prepared by mixing the PVOH/Glycerin solution from Example 1B, the melted Tween 60, and boiling water in a 90 C water bath using and UltraTurrax Mixer at 10,000 rpm. To this mixture is added the melted Rewoquat with mixing. After mixing with the UltraTurrax for 5 minutes, the mixture is transferred into a 5 quart stainless steel bowl of a KitchenAid® Mixer Model K5SS (available from Hobart Corporation, Troy, Ohio). The mixer is fitted with a flat beater attachment and the filled bowl is kept warm using boiling water in an external bath while the mixture is vigorously aerated at high speed for approximately 8 minutes. The resulting aerated mixture is then spread evenly with a spatula into circular Teflon molds (using rubber spatula's straight edge to scrape off excess foam leaving a flat smooth surface level with the top of the mold) with a 4.15 cm diameter and a depth of 1.4 cm which are weighed before and after with average wet mixture weights of 10.353 grams indicating an average wet foam density of approximately 0.546 grams/cm$^3$.

The aerated mixture is then transferred to aluminum molds with dimensions of 16 cm×16 cm×0.75 cm that have been pretreated with Poly-Tergent SLF-18 (ex BASF) for mold release. The filled molds are then placed into a 135° C. convection oven for 1 h, are removed from the oven for cooling. Once cool, the molds containing the dried mixture are weighed with subtraction of the original mold weights indicating dry weights of 58.58 grams. The resulting porous solids are removed from the molds and the thicknesses are measured with a caliper giving 0.724 cm indicating an average resulting dry density of approximately 0.318 grams/cm$^3$ and with an average basis weight of 2300 grams per square meter (gsm).

Example 5

Dissolvable Porous Solid Fabric Conditioners Prepared from a Cationic Surfactant The following dissolving porous solid is prepared in accordance to the present invention:

| Component | Wt % |
|---|---|
| Polyvinyl alcohol premix from Example 1B | 54.4 |
| Tween-60[a] | 5.2 |
| DEEDMAC[b] | 16.0 |
| Water | 24.4 |
| Total | 100.0 |

[a]Available from Sigma, catalog number P1629.
[b]Rewoquat DEEDMAC available from Evonik Industries.

The above composition is prepared by mixing the PVOH/Glycerin solution from Example 1B, the melted Tween 60, and 50 mL of boiling water in a 90 C water bath using and UltraTurrax Mixer at 19,000 rpm for 2 min. To this mixture is added the melted Rewoquat with mixing. After mixing with the UltraTurrax for 4 minutes, the mixture is transferred into a 5 quart stainless steel bowl of a KitchenAid® Mixer Model K5SS (available from Hobart Corporation, Troy, Ohio). The mixer is fitted with a flat beater attachment and the filled bowl is kept warm using boiling water in an external bath. The mixture is vigorously aerated at high speed for approximately 5 minutes, then 100 mL of boiling water is added and mixing is continued for approximately 4 minutes. The resulting aerated mixture is then spread evenly with a spatula into circular Teflon molds (using rubber spatulas straight edge to scrape off excess foam leaving a flat smooth surface level with the top of the mold) with a 4.15 cm diameter and a depth of 1.4 cm which are weighed before and after with average wet mixture weights of 6.61 grams indicating an average wet foam density of approximately 0.349 grams/cm$^3$.

The aerated mixture is then transferred to aluminum molds with dimensions of 16 cm×16 cm×0.75 cm that have been pretreated with Poly-Tergent SLF-18 (ex BASF) for mold release. The filled molds are dried in a convection oven for 0.75 h/113 C. Once dried, the molds containing the dried mixture are weighed with subtraction of the original mold weights indicating dry weights of 31.84 grams. The resulting porous solids are removed from the molds and the thicknesses are measured with a caliper giving 1.0. cm indicating an average resulting dry density of approximately 0.124 grams/cm$^3$ and with an average basis weight of 1240 grams per square meter (gsm).

The following examples 6-12 are prepared as described in example 5.

| Wet Composition | 6 Wt % | 7 Wt % | 8 Wt % | 9 Wt % | 10 Wt % | 11 Wt % | 12 Wt % |
|---|---|---|---|---|---|---|---|
| Polyvinyl alcohol premix from Example 1B | 44.5 | 39.2 | 52.5 | 52.3 | 52.8 | 55.8 | 56.5 |
| Tween-60[a] | 5.4 | 5.1 | 4.9 | 5.0 | 6.1 | 5.3 | 5.3 |
| DEEDMAC[b] | 11.7 | 17.3 | 14.7 | 14.7 | 14.5 | 15.7 | 16.2 |
| Water | 38.4 | 38.4 | 27.9 | 28.0 | 26.6 | 23.2 | 21.9 |
| Total | 100.0 | 100.0 | 100.0 | 100.0 | 100.0 | 100.0 | 100 |
| Solids (%) | 30.0 | 32.1 | 33.9 | 33.9 | 35.2 | 36.1 | 36.5 |
| Wet Density (g/cm$^3$) | 0.254 | 0.334 | 0.393 | 0.377 | 0.577 | 0.326 | 0.382 |

[a]Available from Sigma, catalog number P1629.
[b]Rewoquat DEEDMAC available from Evonik Industries
[c]DIP Quat = bis-(2-hydroxypropyl)-dimethylammonium methylsulphate fatty acid ester Dry Composition and Properties of Examples 5-12 perfume was sprayed onto the porous substrate and the substrate is dried for at least 18 h under ambient conditions.

| Dry Composition | 5 Wt % | 6 Wt % | 7 Wt % | 8 Wt % | 9 Wt % | 10 Wt % | 11 Wt % | 12 Wt % |
|---|---|---|---|---|---|---|---|---|
| Polyvinyl Alcohol | 18.2 | 16.3 | 12.7 | 17.4 | 15.0 | 15.5 | 16.4 | 19.2 |
| Glycerol | 20.2 | 18.0 | 14.0 | 19.3 | 16.6 | 17.2 | 18.2 | 21.2 |
| Tween-60[a] | 12.6 | 14.3 | 11.8 | 11.6 | 10.1 | 12.9 | 11.1 | 12.8 |
| DEEDMAC[b] | 34.7 | 30.7 | 36.4 | 31.6 | 27.4 | 27.7 | 29.9 | 35.7 |
| Remaining Water | 14.3 | 20.7 | 25.1 | 20.1 | 30.9 | 26.7 | 24.4 | 11.1 |
| Total | 100.0 | 100.0 | 100.0 | 100.0 | 100.0 | 100.0 | 100.0 | 100.0 |
| Dry Density (g/cm$^3$) | 0.111 | 0.137 | 0.187 | 0.213 | 0.184 | 0.275 | 0.152 | 0.149 |
| Basis Weight (g/cm$^2$) | 1150 | 840 | 1100 | 1300 | 1500 | 2100 | 1330 | 1230 |
| Dissolution (s) | 315 | 660 | 420 | 540 | 600 | 1080 | 450 | 285 |
| Open Cell Content (%) | 82.5 | 88 | NT | 90 | NT | NT | NT | NT |
| BET Surface Area (cm$^2$/g) | 0.042 | 0.049 | NT | 0.047 | 0.051 | NT | NT | NT |

[a]Available from Sigma, catalog number P1629.
[b]Rewoquat DEEDMAC available from Evonik Industries.
[c]DIP Quat = bis-(2-hydroxypropyl)-dimethylammonium methylsulphate fatty acid ester
NT = Not Tested.

Example 13

Addition of Perfume and Perfume Microcapsules to Example 11

To a 14.57 g specimen of porous substrate from Example 11 is added 0.20 g of encapsulated perfume by spraying on 2.01 g of perfume microcapsule slurry having 9.91% perfume activity, and after 30 min at ambient conditions, 0.19 g of neat perfume was sprayed onto the porous substrate and the substrate is dried for at least 18 h under ambient conditions.

Example 14

Addition of Perfume and Perfume Microcapsules to Example 11

To a 14.53 g specimen of porous substrate from Example 11 is added 0.47 g of encapsulated perfume by spraying on 4.77 g of perfume microcapsule slurry having 9.91% perfume activity, and after 30 min at ambient conditions, 0.65 g of neat

Example 15

Through the Rinse Performance of Examples 13 and 14

Representative fabrics (100% cotton EuroTouch terry towels obtained from Standard Textile, 2250 Progress Dr., Hebron, Ky.) are washed using a Kenmore 80 series, medium fill, 17 gallon, top-loading washing machine using Tide Free liquid on the heavy duty cycle (90° F. Wash/60° F. Rinse). The liquid fabric softener control Downy® and the dissolvable porous substrates from Examples 13 and 14 are added into the final rinse cycle. Fabrics are dried using a Kenmore series dryer on the cotton/high setting for 50 min. The treated fabrics are compared and the difference in softness relative to control is judged by expert graders. Results are expressed using the standard Panel Score Unit scale: +4 psu (very large difference in favor of TEST product) to −4 psu (very large difference in favor of CONTROL product). There is no difference between the liquid fabric softener control and Example 13, and a PSU difference of 0.29 in favor of the control product versus Example 14 where a score of 1 PSU is judged as "I think there might be a difference."

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited herein are incorporated herein by reference in their entirety; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process of making fabric care conditioning article comprising a porous dissolvable solid structure said process comprising the steps of:

a. preparing a solution comprising water, film-forming water-soluble polymer water soluble polymer, plasticizer, diester quaternary ammonium compound and optionally nonionic surfactant wherein said solution:
   i. comprises from about 20% to about 50% solids by weight of said pre-mix; and
   ii. has a viscosity of from about 2,500 centipoise to about 150,000 centipoise;
b. aerating said solution by introducing gas into said solution to form a wet aerated product;
c. forming said wet aerated product into a desired shape to form a shaped wet product;
d. drying said shaped wet product to a desired Remaining Water content to form a porous dissolvable solid structure; and
e. adding perfume to said porous dissolvable solid structure by spraying said perfume onto said structure.

2. The process of claim 1 further comprising the step of adding perfume microcapsules to said porous dissolvable solid structure by spraying a perfume microcapsule slurry onto said structure.

3. The process of claim 1 further comprising the step of adding perfume and perfume microcapsules to said porous dissolvable solid structure.

4. The process of claim 1 further comprising the step of adding perfume particles to said porous dissolvable solid structure by dusting said structure with said particles.

* * * * *